US010267594B2

(12) United States Patent
Saadon

(10) Patent No.: US 10,267,594 B2
(45) Date of Patent: Apr. 23, 2019

(54) AUXILIARY DEVICE MOUNTING SYSTEM FOR FIREARMS

(71) Applicant: FXD, LLC., Austin, TX (US)

(72) Inventor: Marschell B Saadon, Round Rock, TX (US)

(73) Assignee: FXD, LLC, Austin, TX (US)

( * ) Notice: Subject to any disclaimer, the term of this patent is extended or adjusted under 35 U.S.C. 154(b) by 0 days.

(21) Appl. No.: 15/640,490

(22) Filed: Jul. 1, 2017

(65) Prior Publication Data

US 2017/0363385 A1 Dec. 21, 2017

Related U.S. Application Data

(63) Continuation of application No. 14/833,147, filed on Aug. 24, 2015, now Pat. No. 9,696,111.

(60) Provisional application No. 62/041,725, filed on Aug. 26, 2014, provisional application No. 62/170,285, filed on Jun. 3, 2015, provisional application No. 62/193,058, filed on Jul. 15, 2015.

(51) Int. Cl.

| | |
|---|---|
| ***F41C 23/16*** | (2006.01) |
| ***F41G 11/00*** | (2006.01) |
| ***F41C 23/14*** | (2006.01) |
| ***F41C 23/12*** | (2006.01) |

(52) U.S. Cl.

CPC ..... *F41C 23/16* (2013.01); *F41C 23/12* (2013.01); *F41C 23/14* (2013.01); *F41G 11/003* (2013.01)

(58) Field of Classification Search

CPC ..... F41C 23/16; F41C 23/14; F41C 23/18; F41A 19/10; F41A 21/00; F41G 11/003

USPC ..... 42/71–73; D22/108

See application file for complete search history.

(56) References Cited

U.S. PATENT DOCUMENTS 2,056,975 A * 10/1936 Michal, Jr. ..... F41A 19/44 42/106
2,899,767 A * 8/1959 Boudreau ..... F41A 9/41 42/106
3,128,571 A * 4/1964 Herrett ..... F41C 23/10 42/71.02
4,475,437 A * 10/1984 Sullivan ..... F41A 3/72 42/70.06
5,048,215 A * 9/1991 Davis ..... F41A 35/06 42/71.01

(Continued)

FOREIGN PATENT DOCUMENTS

CN 2321482 Y 6/1996
WO 1985005442 A1 12/1985
WO WO-2012021216 A2 * 2/2012 ..... F41C 23/14

OTHER PUBLICATIONS

AFG-2-Angled Fore Grip 1913 Picatinny, Magpul.com, [online], [site visited Oct. 13, 2016]. <URL: https://www.magpul.com/products/afg-2>.

(Continued)

*Primary Examiner* — John Cooper

(57) ABSTRACT

A mounting system includes a rail system. The rail system can include a plurality of powered rails and at least one control rail. The rail system can be disposed on a firearm, extending along the barrel toward a front of the firearm. The front or forward direction of the firearm extends from the trigger toward the distal end of the barrel. The rail system can extend along the barrel forward of the trigger, stock, and firearm handle.

20 Claims, 21 Drawing Sheets

(56) References Cited

U.S. PATENT DOCUMENTS 6,782,791 B2 * 8/2004 Moore ..... F41A 3/22 89/1.4
7,055,749 B2 6/2006 Wulff
7,111,424 B1 9/2006 Moody
7,140,138 B1 * 11/2006 Laney ..... F41A 19/14 42/69.03
7,454,858 B2 11/2008 Griffin
D585,517 S * 1/2009 Faifer ..... D22/108
7,568,304 B1 8/2009 Moody
7,676,975 B2 3/2010 Phillips et al.
D617,863 S 6/2010 Moody
D633,163 S 2/2011 Fitzpatrick
D642,651 S 8/2011 Faifer
D643,497 S * 8/2011 Fitzpatrick ..... D22/108
D644,707 S 9/2011 Faifer
D657,217 S 4/2012 Chang
D660,934 S 5/2012 Faifer
D665,043 S 8/2012 Fitzpatrick
8,245,428 B2 8/2012 Griffin
8,533,987 B2 * 9/2013 Rogers ..... F41C 23/16 42/72
D693,424 S 11/2013 Wristen
8,607,492 B2 * 12/2013 Hartley ..... F41C 23/16 42/72
D698,405 S 1/2014 Kline
D698,885 S 2/2014 Faifer
8,707,604 B2 4/2014 Troy et al.
D704,298 S 5/2014 Cheng
8,826,792 B1 * 9/2014 Granger ..... F41A 1/06 89/7
8,857,094 B2 * 10/2014 Michel ..... F41C 23/14 42/71.01
D726,278 S 4/2015 Ding
D727,455 S 4/2015 Ding
D728,054 S 4/2015 Webber
9,010,008 B2 * 4/2015 Hovey ..... F41C 23/16 42/72
D743,418 S 11/2015 Herold
9,182,194 B2 * 11/2015 Moore ..... F41C 23/16
D745,623 S 12/2015 Flores
D745,624 S 12/2015 Flores
D745,628 S 12/2015 Barfoot
D745,629 S * 12/2015 Barfoot ..... D22/108
D745,940 S 12/2015 Flores
9,228,786 B2 * 1/2016 Sullivan ..... F41A 3/26
9,234,721 B2 1/2016 Hines
D749,186 S 2/2016 Cheng
9,341,440 B2 5/2016 Moore
9,423,208 B1 8/2016 Mahmalji
2005/0024691 A1 2/2005 Mowers
2005/0246910 A1 * 11/2005 Mowers ..... F41G 1/467 33/266
2008/0010890 A1 * 1/2008 Vice ..... F41C 23/16 42/72
2008/0141576 A1 6/2008 Moody
2009/0193702 A1 8/2009 Lin
2009/0194088 A1 * 8/2009 Tippmann, Jr. ..... F41A 11/00 124/74
2010/0031552 A1 * 2/2010 Houde-Walter ..... F41A 35/00 42/72
2010/0242332 A1 9/2010 Teetzel
2011/0047850 A1 3/2011 Rievley
2011/0047851 A1 * 3/2011 Mock ..... F41C 23/16 42/72
2011/0107643 A1 5/2011 Fitzpatrick et al.
2011/0173862 A1 7/2011 Williams
2011/0179688 A1 7/2011 Ash, Jr.
2011/0185617 A1 * 8/2011 Brixius ..... F41C 23/12 42/71.01
2012/0272557 A1 11/2012 Yan
2013/0074685 A1 * 3/2013 Cottle ..... F41A 19/06 89/27.11
2013/0205636 A1 8/2013 Shull
2013/0239450 A1 * 9/2013 Michel ..... F41C 23/14 42/73
2013/0333263 A1 * 12/2013 Hovey ..... F41C 23/16 42/72
2013/0340311 A1 * 12/2013 Marquez ..... F41A 11/02 42/72
2014/0245648 A1 * 9/2014 Nierenberg ..... F41C 23/08 42/1.06
2014/0373414 A1 * 12/2014 Nierenberg ..... F41A 3/66 42/1.06
2015/0233668 A1 * 8/2015 Moore ..... F41C 23/16 42/72
2016/0061560 A1 * 3/2016 Saadon ..... F41G 11/003 42/72
2016/0245616 A1 8/2016 Derousse

OTHER PUBLICATIONS

Stark Equipment Express Angled Fore-Grip (Black), AirsoftGI.com, [online], [site visited Oct. 13, 2016]. <URL: http://www.airsoftgi.com/product_info.php?products _id=15182>.

* cited by examiner

FIG. 13
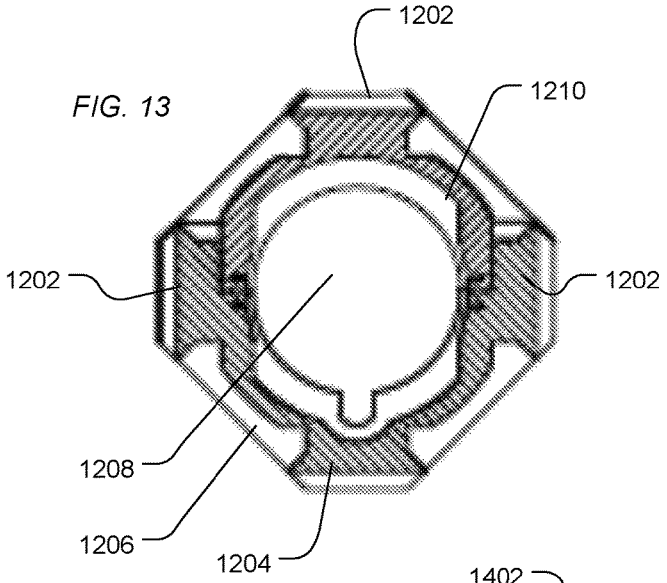
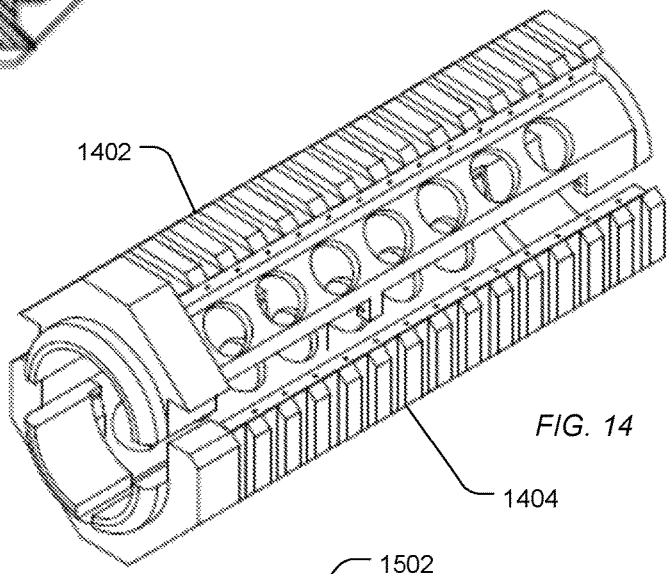
FIG. 14
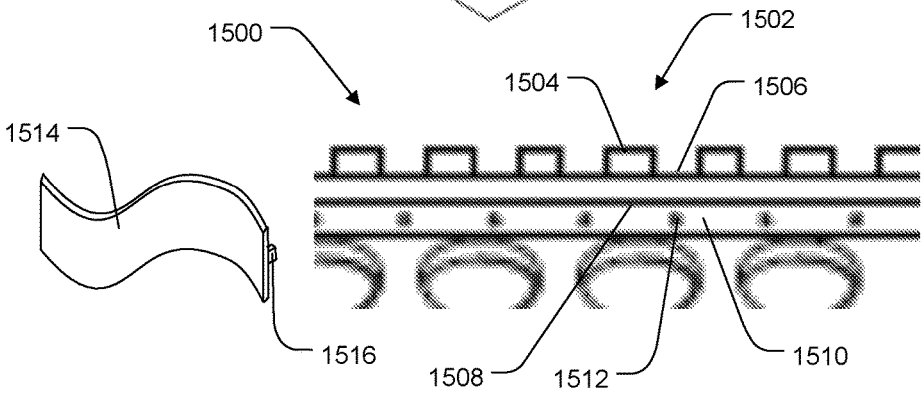
FIG. 15

FIG. 37
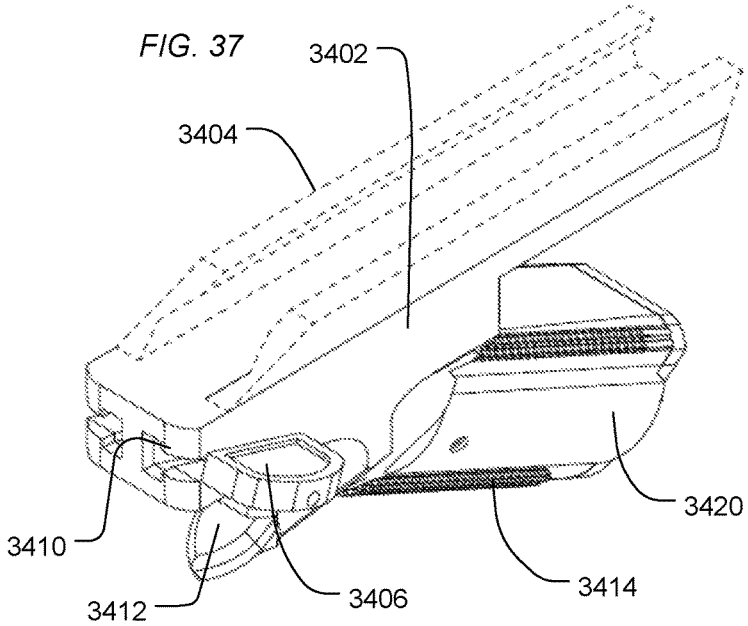
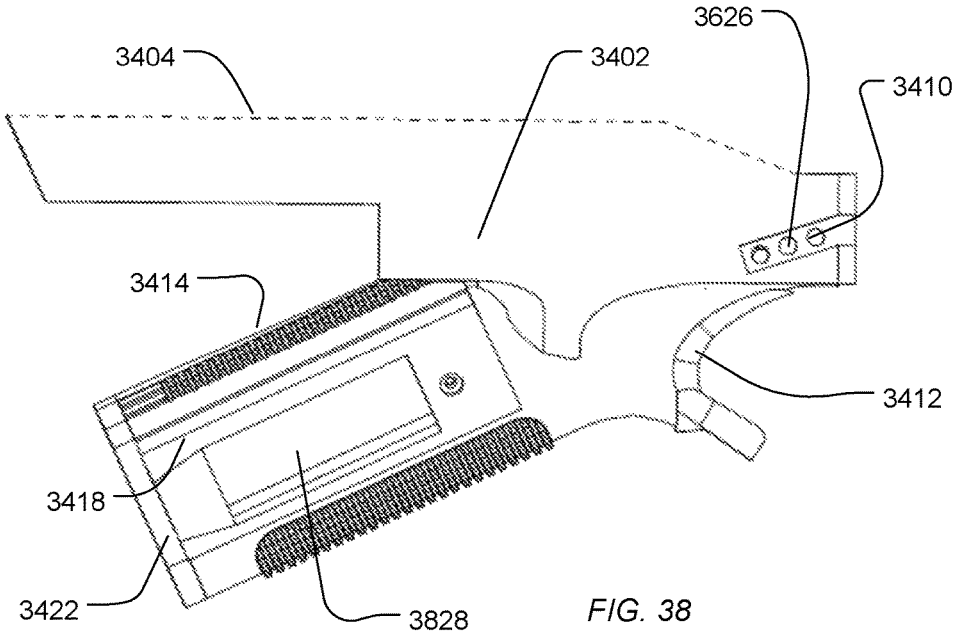
FIG. 38

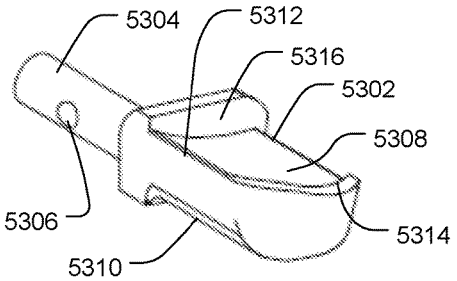
FIG. 53
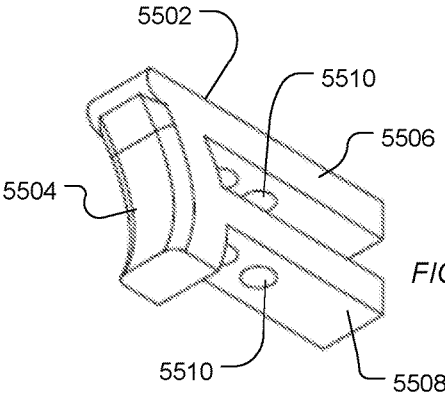
FIG. 55
FIG. 54
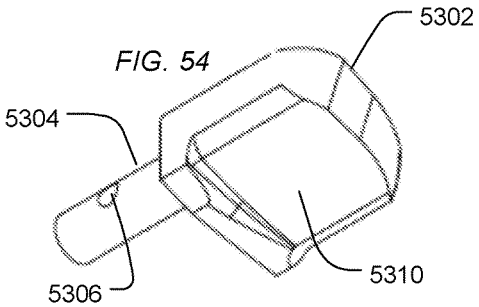
FIG. 58
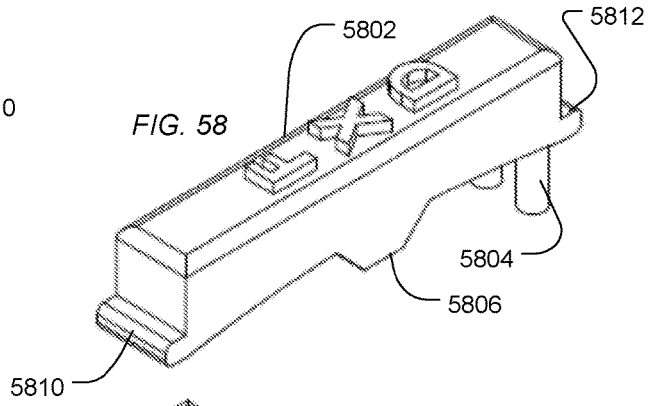
FIG. 56
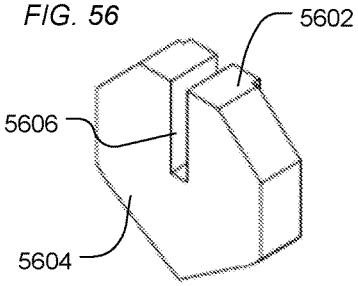
FIG. 59
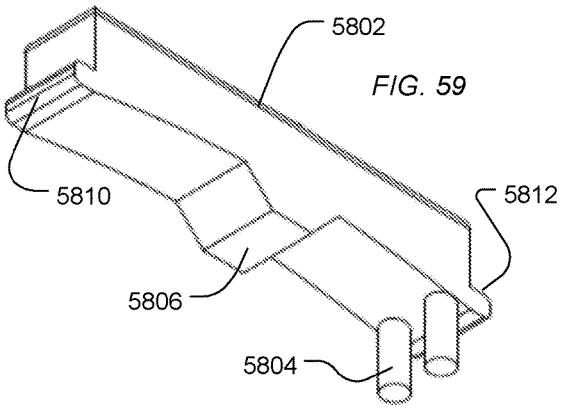
FIG. 57
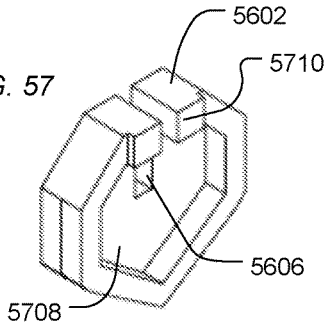

AUXILIARY DEVICE MOUNTING SYSTEM FOR FIREARMS

CROSS-REFERENCE TO RELATED APPLICATION(S)

This application is a continuation of U.S. patent application Ser. No. 14/833,147, filed Aug. 24, 2015 (now U.S. Pat. No. 9,696,111), which claims benefit of U.S. Provisional Application No. 62/041,725, filed Aug. 26, 2014, claims benefit of U.S. Provisional Application No. 62/170,285, filed Jun. 3, 2015, and claims benefit of U.S. Provisional Application No. 62/193,058, filed Jul. 15, 2015, each of which is incorporated herein by reference in its entirety.

FIELD OF THE DISCLOSURE

This disclosure, in general, relates to a mounting system for mounting auxiliary devices to firearms, methods of using such mounting systems, methods of manufacturing such mounting systems.

BACKGROUND

As demand has increased for firearms, so too has demand for auxiliary devices, such as laser sights, infrared light sources, and visible light spectrum sources. Demand for such auxiliary devices is particularly strong in military, civilian defense, and police applications. Many operations occur at night or in low light conditions, rendering weapon mounted lighting systems desirable. But, such systems tend to suffer from deficiencies in power limitations, activation methodologies, and the obstruction of a firearm user's forward view.

As such, improved auxiliary devices and associated mounting systems would be desirable.

BRIEF DESCRIPTION OF THE DRAWINGS

The present disclosure may be better understood, and its numerous features and advantages made apparent to those skilled in the art by referencing the accompanying drawings.

FIG. 13 includes a cross-sectional view of an exemplary rail system.

FIG. 14 includes an illustration of an exemplary rail system.

FIG. 15 includes an illustration of an exemplary powered rail.

FIG. 34-42 include illustrations of an exemplary handle.

FIG. 53 and FIG. 54 include illustrations of an exemplary thumb paddle.

FIG. 55 includes an illustration of an exemplary index finger insert.

FIG. 56 and FIG. 57 include illustrations of an exemplary cover plate.

FIG. 58 and FIG. 59 include illustrations of an exemplary pressure pad activator.

The use of the same reference symbols in different drawings indicates similar or identical items.

DETAILED DESCRIPTION

In an exemplary embodiment, a mounting system includes a rail system. The rail system can include a plurality of powered rails and at least one control rail. The rail system can be disposed on a firearm, extending along the barrel toward a front of the firearm. The front or forward direction of the firearm extends from the trigger toward the distal end of the barrel. The rail system can extend along the barrel forward of the trigger, stock, and firearm handle.

A control handle that includes a power supply is attached to the control rail of the rail system to provide power to the plurality of powered rails of the rail system. Accessory devices can be mounted to the rail system, for example, to the powered rails. The powered rails can provide power to the accessory devices. An exemplary accessory device includes a visible light source, an infrared light source, a laser source, or combination thereof. In an example, the handle includes a control interface that interfaces with the control rail, provides power to the powered rails, and includes a mode select button and an activation button. A select mode can be activated by selecting a particular mode using the modes select button and depressing the activation button. Optionally, a head device including one or more light sources is attached to the front end of the rail system. In an example, the head device includes a plurality of visible light spectrum light sources and plurality of infrared light sources. Optionally, the head device can include a laser light source.

In another exemplary embodiment, a head device disposed toward a front of the firearm, optionally attached to a rail system, includes a plurality of light sources. In an example, the head device includes a plurality of visible light sources and a plurality of infrared light sources. In an example, the head device can also include a plurality of laser light sources. In a particular example, the visible light sources are disposed to project forward from the head device on opposite sides of a vertical axis of symmetry of the head device. Two of the plurality of infrared light sources can be disposed on opposite sides of the vertical axis of symmetry. For example, a first of the plurality of infrared light sources is disposed on a first side of the axis of symmetry and a second of the plurality of infrared light sources is disposed on the other side of the vertical axis of symmetry. The head device can further include a mounting connector for connecting the device to a mounting system of a firearm. In an example, the mounting system is a rail system and the mounting connector of the head device is attached to a rail of the rail system.

Figure 1:
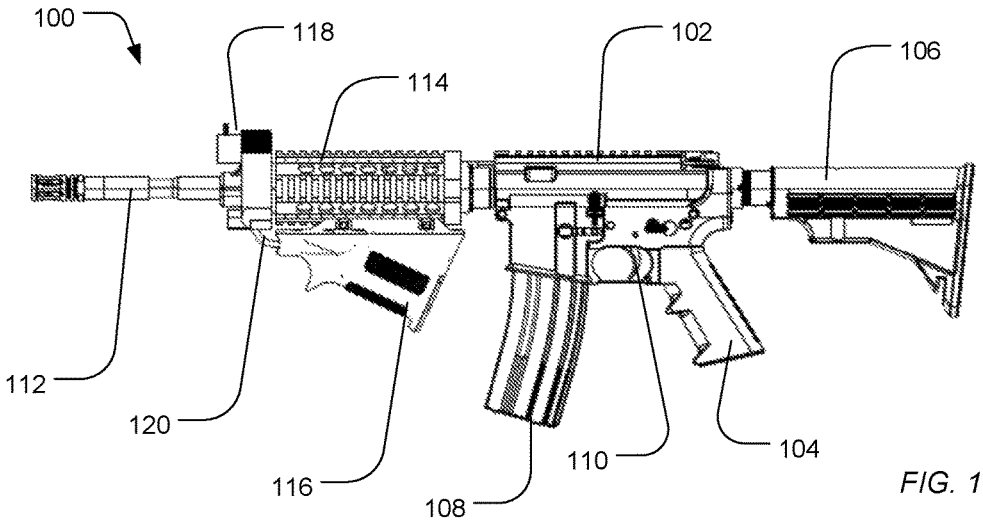
FIG. 1 and FIG. 2 include illustrations of an exemplary firearm with a powered mounting system.
Figure 2:
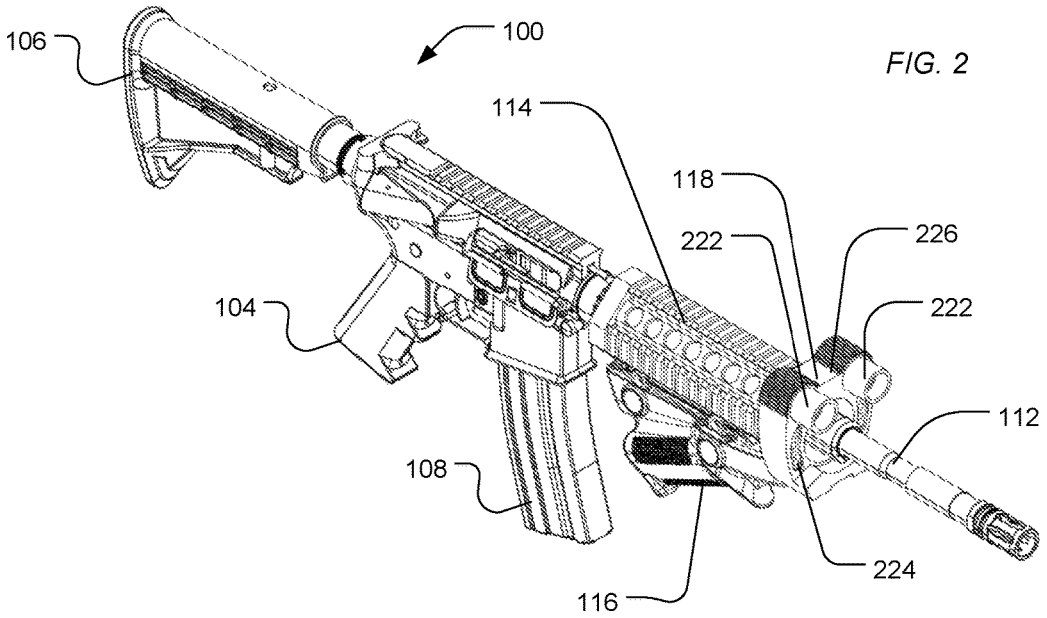

In an exemplary embodiment illustrated in FIG. 1 and FIG. 2, a firearm 100 includes a body 102 having a firearm handle 104 and a trigger 110. The body 102 can interface with a cartridge 108 to supply ammunition. The body 102 can attached to a barrel 112. The distal end of the barrel 112 forms a front of the firearm 100. A stock 106 can be attached to the body 102 at a rear of the firearm.

Along the barrel 112 and forward of the stock 106, firearm handle 104, and trigger 110 is disposed a rail mounting system 114, forming part of a handguard. The rail mounting system 114 can include a plurality of rails to which auxiliary devices are optionally attached and can include a control rail to which a control handle 116 is attached. Optionally, a head device 118 can be attached to the rail mounting system 114, and the head device 118 can be controlled by the control handle 116 through the rail mounting system 114, through a wire interface 120, or through a unitary or solid electrical connector formed or connected between the head device 118 and the handle 116.

In a particular example illustrated in FIG. 2, the head device 118 attaches to the rail mounting system 114 using a rail mounting connector 226. On opposite sides of a vertical axis of symmetry, the head device 118 includes visible light sources 222. In addition, the head device 118 can include a plurality of other light sources, such as infrared light sources, laser light sources, or any combination thereof. Additional accessory devices can be further attached to the head, such as cameras, additional lights, laser pointers, or Taser devices.

Figure 3:
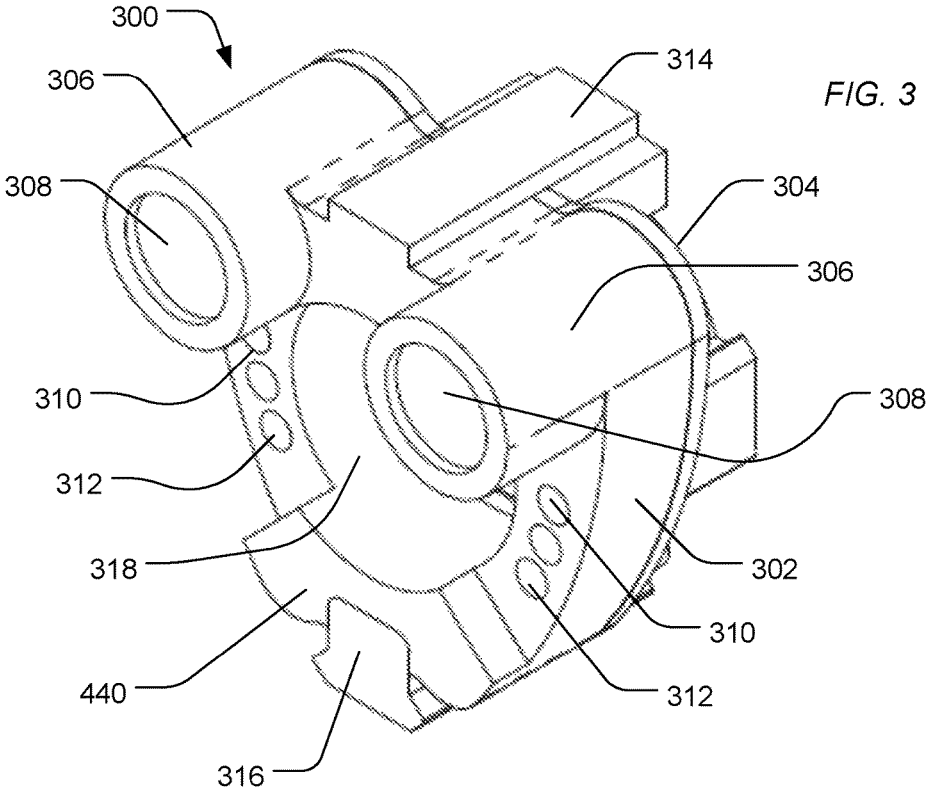
FIG. 3 includes an isometric view of an exemplary head device.

In an example, a head device includes a housing, main light assembly, infrared (IR) light assemblies, a powered cradle, internal wiring, a fixed connector, a floating connector, an insulating substance, or a back plate. For example, as illustrated in FIG. 3, a head device 300 includes a housing 302 and a back plate 304 to the housing 302. The housing 302 can define cavities 306 at the top and on opposite sides of a vertical axis of symmetry to house visible light sources 308. The housing 302 can further house light sources of different spectrums disposed on opposite sides of the vertical axis of symmetry. For example, the housing 302 can include light sources, such as infrared, ultraviolet, red, green, blue, multi-color, or blue laser light sources, or a combination thereof. For example, infrared light sources 310 can be disposed on opposite sides of the axis of symmetry. In another example, red, green, blue, or multi-color visible spectrum light sources 312 can be disposed on opposite sides of the axis of symmetry within the housing 302. In a further example, ultraviolet light sources can be disposed on opposite sides of the axis of symmetry. In an additional example, sensors can be disposed in addition to or in place of one or more of the light sources and optionally on either or both sides of the axis of symmetry within the housing. An example sensor can include a thermal sensor, such as an infrared sensor.

The housing 302 defines a central bore 318 through which the barrel extends or through which a bullet may pass. The housing 302 can further define a connector 314 to assist with connecting the head device 300 to a rail mounting system. In an example, the connector 314 is disposed at a top of the head device 300 and defines a structure similar to a rail to which the head device 300 is to be mounted. A complementary connector connecting a rail of the rail mounting system to the rail connector 314 can provide interconnection between the rail mounting system and the head device 300. Alternatively, the connector 314 can be fixed rail mounting device or structure. In an example, the connector 314 is a fixed rail connector having a complementary Picatinny configuration or a KeyMod configuration.

The head device 300 can further include a second connector 316 to optionally connect the head device 300 to the rail mounting system. Alternatively, the connector 316 can be floating connector or can allow connection of additional devices to the head device 300. In a particular example, the second connector 316 is disposed near the bottom of the head device 300.

In an example, the head device 300 can be formed of a heat resistant material, such as a high temperature plastic polymer or metal. For example, the housing 302 can be made from thermal molded plastic, cast or milled metal, or other appropriate materials.

Figure 4:
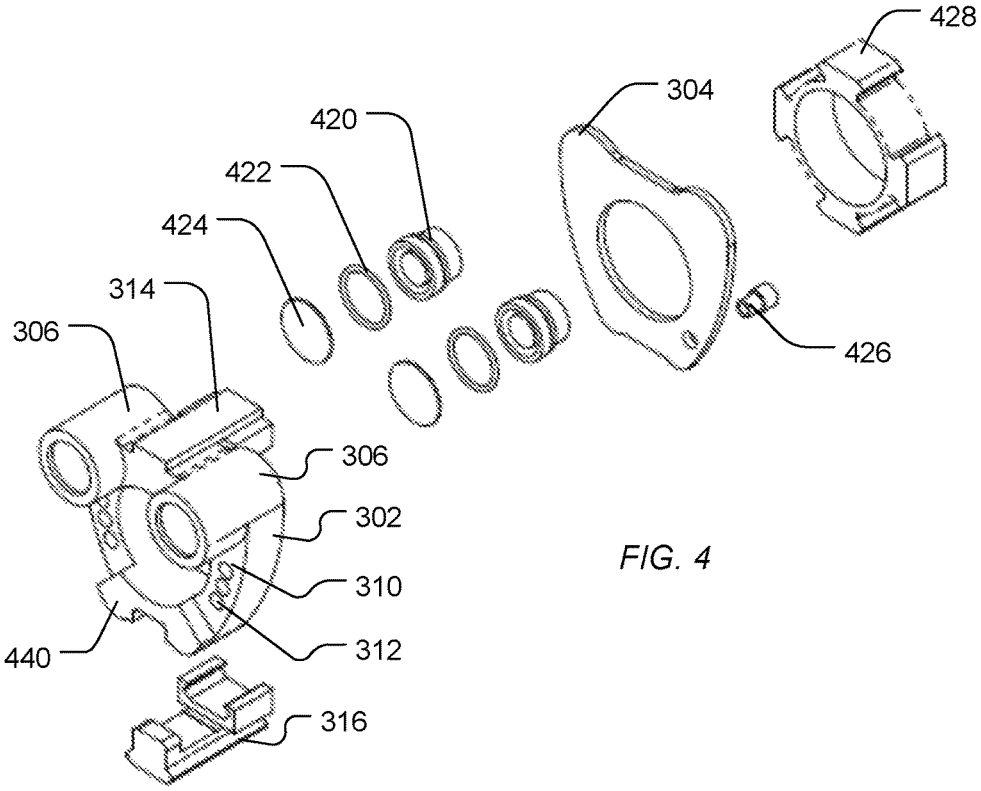
FIG. 4 and FIG. 5 include exploded views of an exemplary head device.
Figure 5:
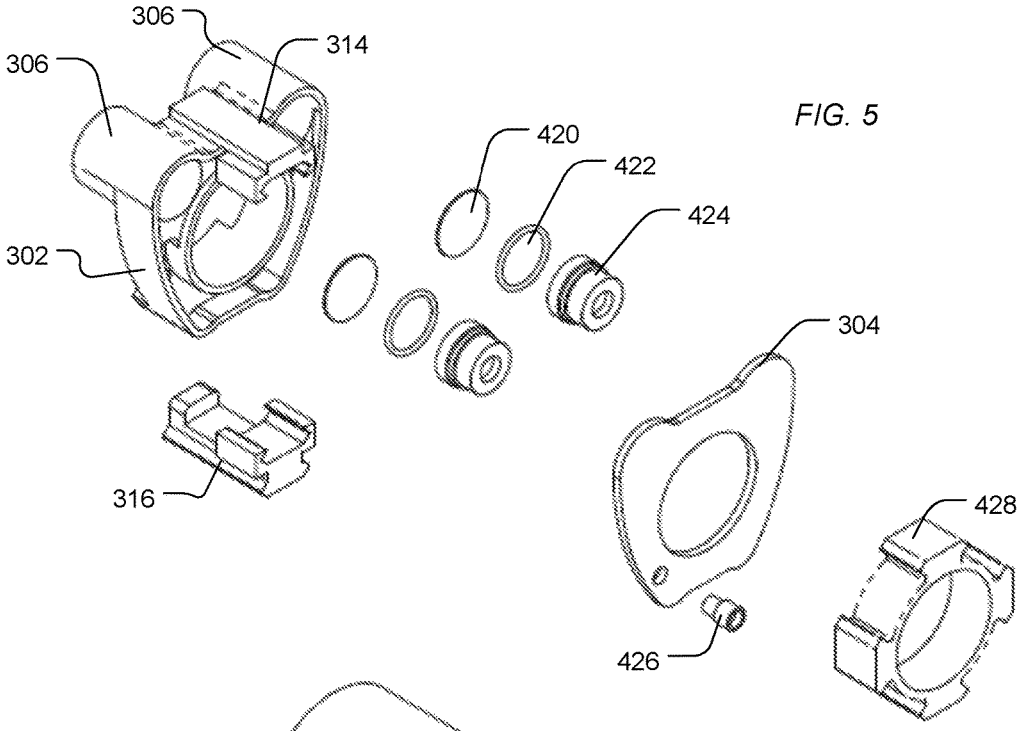

FIG. 4 and FIG. 5 include exploded view illustrations of the head device 300. A lens 424, spacer 422, and visible light source 420 can be disposed within the cavity 306 defined by the housing 302. In particular, the visible light source 420 can be a drop-in manufactured component. The light source 420 can have the capacity to generate light with various colors, intensities, and strobe patterns, for example, as controlled by an external controller, such as a handle controller.

A back plate 304 can be connected to the housing 302 to form a watertight sealed housing. A waterproof electronic connector 426 can connect to the back plate 304 of the head device 300. In particular example, when viewed from the rear, the electronic connector 426 is disposed on the left side of the head device 300.

As illustrated in FIG. 4 and FIG. 5, the connector 314 is a fixed connector for mounting the head device 300 to a rail mounting system 428. In an alternative example, an adjustable connector can be provided to attach the head device 300 to the rail mounting system 428.

An adjustable connector 316 can be used to provide further support and connect the head device 300 to the rail mounting system 428. Alternatively, the connector and interface 316 can connect the head device 300 to additional devices. In an example, an additional device includes a Taser, laser, camera, night vision, solar charging assembly, weights for recoil or rise compensation, or any combination thereof.

In an additional example, the head device 300 can include an interface to attach additional equipment to the connector of the head device 300. For example, the connector 316 can be adjusted to connect other devices to a bottom of the head device. The connector 316 can include an electronic interface for controlling the additional device. Alternatively, a split cable can be provided that includes an interface for the electrical connector 426 and connections for the additional device.

In a particular example, a power cradle can be defined under and protected by plate 440. The power cradle can include a floating connector and can further define an internal well and a track which allow the floating connector to move in and out of the housing. In another example, the powered cradle includes a powered connector to receive an auxiliary device, such as a camera, thermal camera, laser, Taser, thermal sensor, sound sensor, tracking device delivery system, weights for recoil and rise compensation, night vision, a solar charging assembly or a combination thereof. In an example, a plurality (e.g., two, three, or four) metal cradle tabs connect the wiring harness of the internal wiring to the powered cradle at cradle slots, which can be used to control an auxiliary device attached to the power cradle.

In an example, internal wiring includes circuitry, connections, and shielded or unshielded wire, which can be used to deliver electrical power to the various components of the device. The internal wiring can be configured in a Y-shaped harness, delivering power from the power connector multi controller (e.g., the electrical connector 426 or an internal power source) to the powered cradle, the main light assemblies 308, and the IR light assemblies 310. The internal wiring can be secured to the components with locking connectors at each of the nodes.

In a further example, the head device 300 can be filled with a heat resistant or electrically insulative medium. For example, an electrical and thermal insulating substance in the form of a gel, paste, epoxy, or other viscous medium can be used to cover the electrical connections and components interior to the housing 302. A rear gasket and back plate 304 can attach to the beveled rear opening of the housing 302, and can be fixed in place, for example, by back plate screws through back plate screw holes.

A power connector hole at the lower portion of the back plate houses the female power connector (e.g., electrical connector 426), which can be sealed by a power connector O-ring, a power connector nut, and power connector sealant. In an example, the female power connector is a four post, four ground connector, or a similarly configure connector. In a particular example, the female power connector can be attached to an external multi-controller and power source which powers and facilitates various modes of operation for the main light assemblies, IR light assemblies, and powered cradle of the head device 300.

Figure 6:
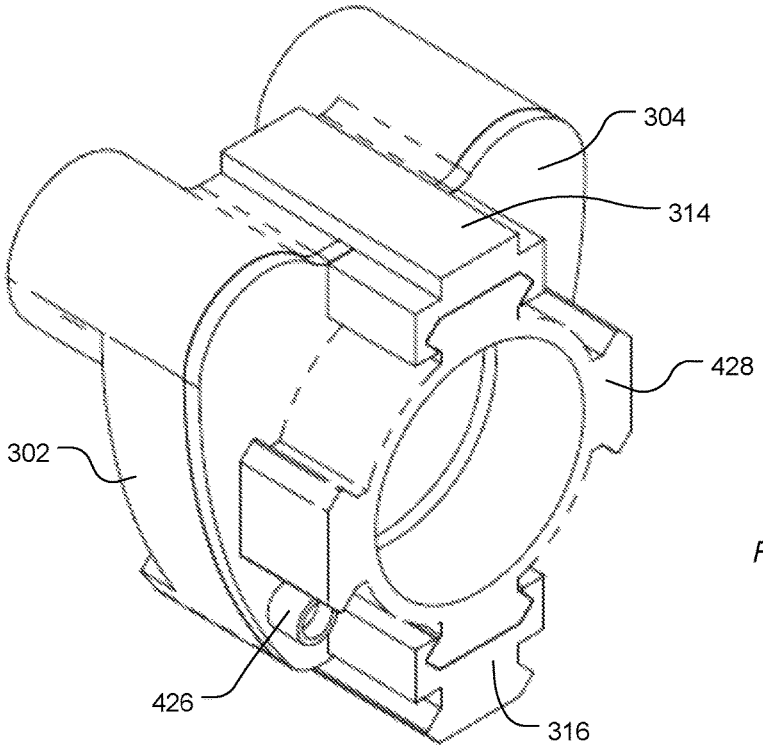
FIG. 6 includes a rear isometric view of an exemplary head device.
Figure 7:
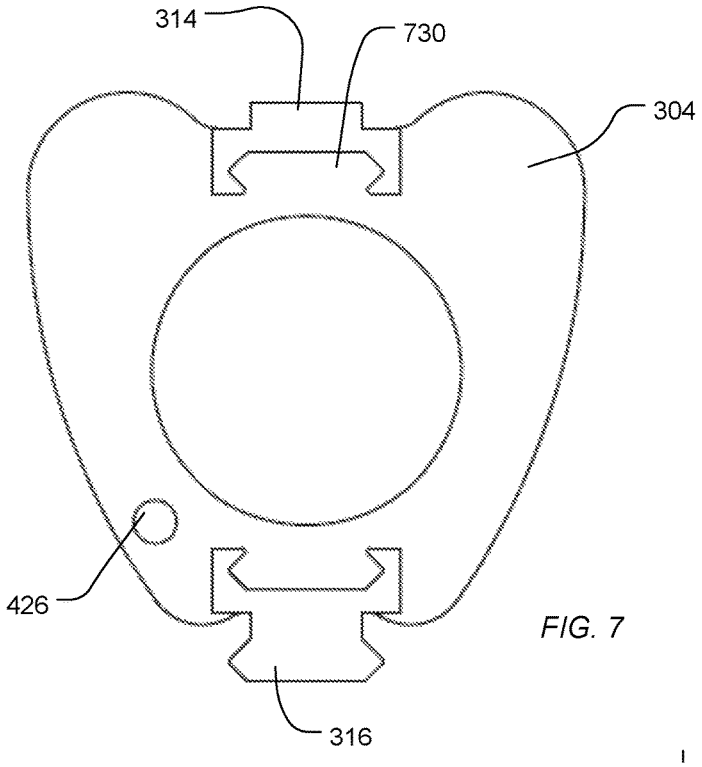
FIG. 7 includes a rearview of an exemplary head device

As illustrated in FIG. 6 and FIG. 7, at the rear, the head device 300 connects to the rail mounting system 428. In an example, a fixed rail mounting connector 314 can connect the top of the head device 300 to a top rail of the rail mounting system 428. An adjustable or floating connector 316 can connect a bottom rail of the rail mounting system 428 to the head device 300. Alternatively, the floating connector 316 can be replaced with an additional auxiliary device.

As further illustrate in FIG. 6 and FIG. 7, the waterproof multi-wire connector 426 can be provided at the rear of the head device 300. The electrical multi-wire connector 426 can connect to a control handle.

Figure 9:
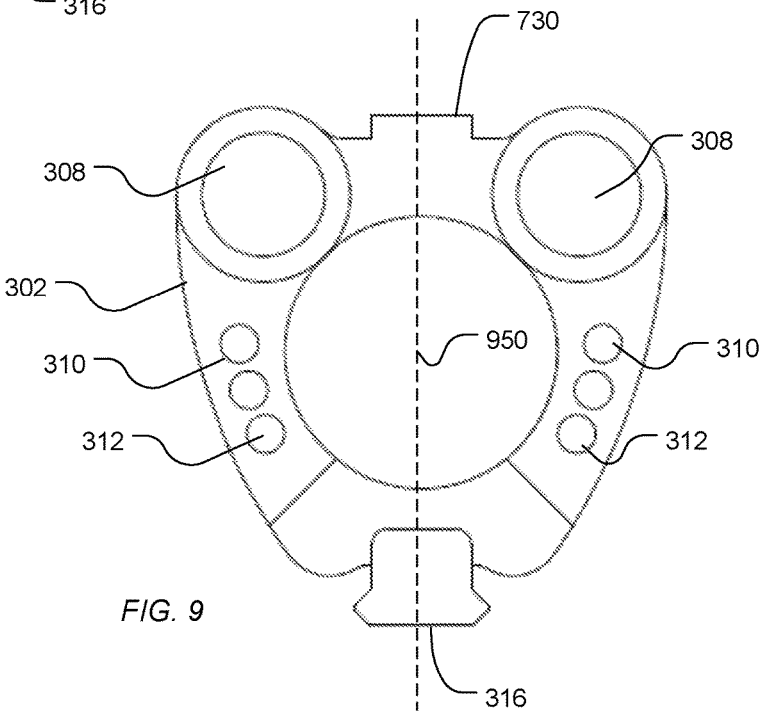
FIG. 9 includes a front view of an exemplary head device.

When viewed from the front as illustrated in FIG. 9, the head device 300 includes a plurality of visible light devices 308 disposed on opposite sides of a vertical axis of symmetry 950. In particular, a first light source 308 can be disposed on a first side of the axis of symmetry 950 and another visible light source 308 can be disposed on an opposite side of the axis of symmetry 950.

In addition, the plurality of infrared light sources 310 can be disposed within the housing 302. For example, a set of infrared light sources can be disposed on a first side of the axis of symmetry 950, and another set of the infrared (IR) light sources can be disposed at opposite side of the axis of symmetry 950. In an example, the sets of IR light sources can be assemblies of pairs of infrared light emitting diodes and can be Cree LED, incandescent, or Xenon assemblies or any other forms.

Further, other light sources 312 can be disposed within the housing. In particular examples, opposing sets of light sources 312 can be disposed on opposite sides of the axis of symmetry 950. In particular, light sources 312 of the same type can be disposed on opposite sides of the axis of symmetry 950. Optionally, the housing 302 can include a power supply.

Figure 8:
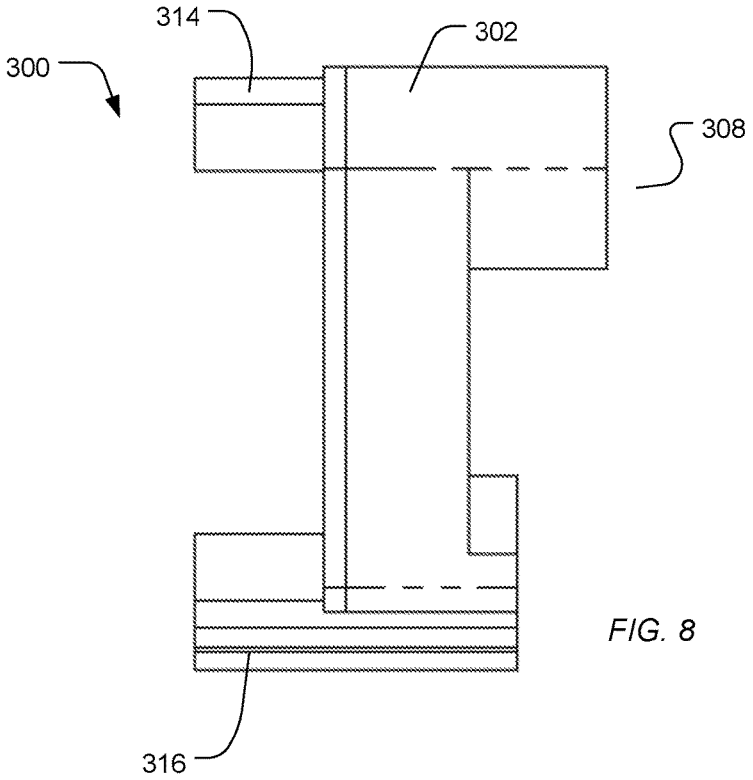
FIG. 8 includes a side view of an exemplary head device.
Figure 10:
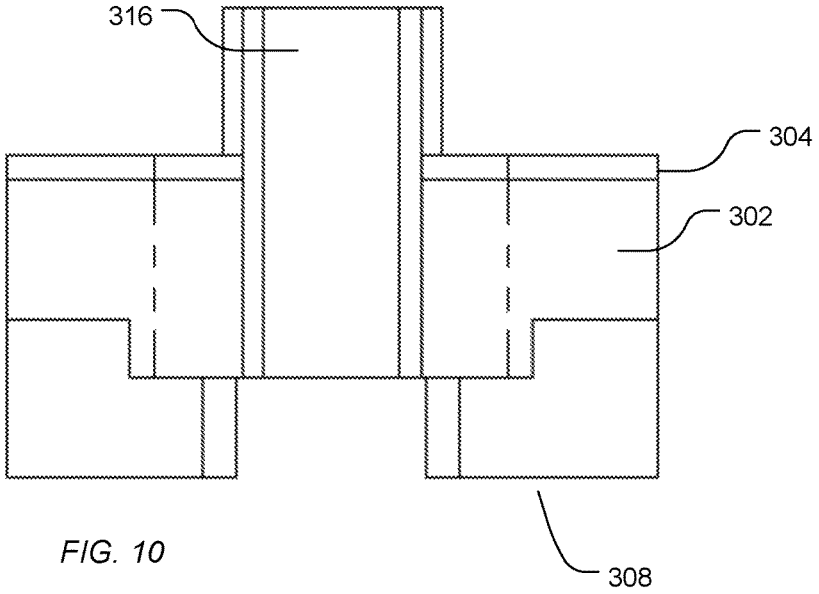
FIG. 10 includes a bottom view of an exemplary head device.
Figure 11:
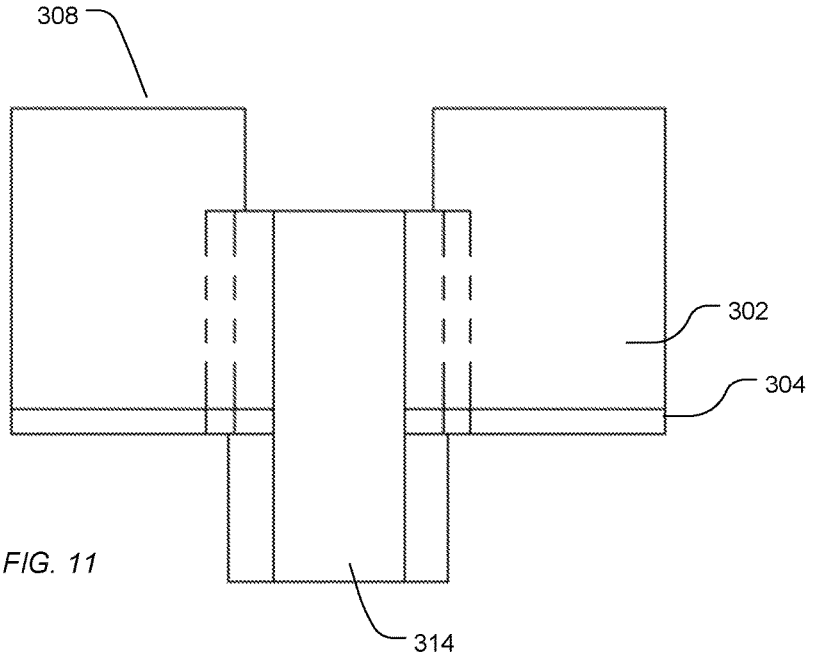
FIG. 11 includes a top view of an exemplary head device.

FIG. 8, FIG. 10, and FIG. 11 include illustrations of different views of the head device 300. For example, FIG. 8 includes a side view of the head device 300 in which the housing 302 connects to connectors 314 or 316 and the light sources 308 extend from a top of the head device 300 in a forward direction.

Figure 12A:
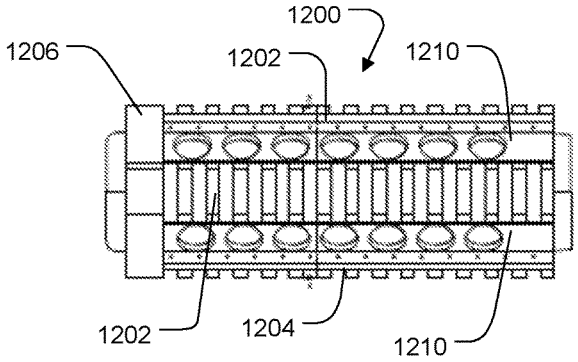
FIG. 12A and FIG. 12 B include illustrations of an exemplary rail system.
Figure 12B:
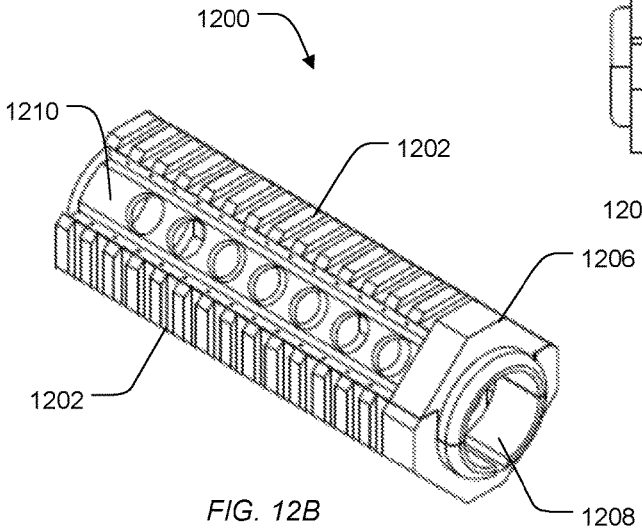

In a further example, FIG. 12A and FIG. 12B illustrate a rail mounting system 1200. The rail mounting system 1200 includes a plurality of powered rails 1202 and a control rail 1204. A support 1210 supports the rails 1202 and 1204 and defines a central bore 1208 through which a barrel of a firearm can extend.

As illustrated, the rail mounting system 1200 includes three powered rails 1202. In general, the rail mounting system 1200 can include at least one powered rail 1202, such as at least two powered rails 1202, at least three powered rails 1202, or four or more powered rails 1202. Generally, the mounting system 1200 does not include greater than 10 powered rails.

The powered rails 1202 can have a Picatinny configuration. In another example, the powered rails can have a KeyMod™ configuration. In an additional example, the powered rails can have an M4 Rail™, LiteRail™, RIS II, or Omega Rail™ configuration, or a combination thereof. In a further example, the powered rails 1202 can have a propriety mounting configuration. While the illustrated embodiments of the rail mounting system 1200 illustrate each of the powered rails 1202 as providing the same mounting configuration, each of the powered rails 1202 can have a different mounting configuration.

The control rail 1204 can have a mounting configuration similar to the mounting configuration of the powered rails 1202. In another example, the control rail 1204 can have a Picatinny configuration. In a further example, the controller 1204 can have a KeyMod configuration. In an additional example, the control rail can have an M4 Rail™, LiteRail™ RIS II, or Omega Rail™ configuration, or a combination thereof. Alternatively, the control rail 1204 can have a proprietary mounting configuration.

The control rail 1204 can provide power to one or more of the plurality of powered rails 1202. In particular, a handle including a power supply or another power supply interfacing with the control rail 1204 can provide power through electrical conduits to each of the plurality of powered rails 1202. In a particular example, the control interface of the control rail 1204 can allow for selectively providing power to select individual powered rails 1202 without providing power to the other powered rails. As such, one or more of the powered rails 1202 can operate and be provided power independently.

Further, the system allows for different voltages in different wave patterns to be provided to select individual powered rails 1202. For example, a power supply interfacing with the control rail 1204 can provide a first voltage or first waveform to one of the power rails 1202 operating a different voltage or a different waveform than another of the powered rails 1202. In particular, depending on the power supply, voltages of 1.5 V, 3V, 6V or 9V can be provided to select rails of the plurality of powered rails. Further, different waveforms can be provided to a powered rail, such as a constant, a square waveform, a sinusoidal waveform, a saw tooth waveform, or a combination thereof.

In a particular example, the electrical conduits can extend from the control rail 1204 to the individual powered rails 1202 through a rim structure 1206 that extends around the circumference of the support 1210. For example, the rim 1206 can extend along a leading-edge or a back edge of the support 1210. In an alternative example, the rim structure 1206 can extend around the support 1210 at a position between the front and back of the support 1210.

When viewed in cross-section, as illustrated in FIG. 13, the rail mounting system 1200 provides for the powered rails 1202 and control rail 1204 to be distributed around the circumference of the support 1210. The support 1210 defines the central bore 1208 through which a barrel of a firearm can extend. As illustrated, the rails 1202 or 1204 are distributed evenly around the circumference of the support 1210. In an alternative example, the rails 1202 or 1204 can be distributed unevenly around the circumference of the support 1210.

As illustrated, the control rail 1204 resides in a bottom position of the support 1210, while three powered rails 1202 are distributed with offsets of 90° from each other around the circumference of the support 1210. The rim 1206, which can house the electrical conduits from a control rail 1204 to the powered rails 1202, can extend around the circumference of the housing 1204 either at a front edge of the support 1210 or a back edge of the housing support 1210.

While FIG. 12A and FIG. 12B illustrate the rail mounting system 1200 as a single piece system, the rail mounting system can be supplied is a multi-part system, as illustrated in FIG. 14. For example, a top piece 1402 can be attached to a bottom piece 1404 to connect around a barrel of a firearm. Alternatively, two side pieces can be attached around opposite sides of a barrel to form the rail mounting system. In particular, a multi-piece rail mounting system finds use for front sight mounted weapons in which the front sight mounting limits access to the barrel from the distal end of the barrel.

FIG. 15 illustrates an exemplary powered rail 1500. The powered rail 1500 includes coupling positions 1502 at which an auxiliary device can be coupled. In the Picatinny configuration illustrated, the attachment site can include one or more teeth 1504 and a lower surface 1506. Along the side of the rails can extend a ridge 1508 to assist with the attachment of an auxiliary device to the rail system. A coupler associated with the auxiliary device can extend around the ridge 1508, securing the auxiliary device to the ridge and preventing side-to-side and vertical motion.

Below the ridge 1508 is a side surface 1510 disposed on each side of the rail 1500. At each of the attachment positions, the powered rail 1500 can include power access points 1512. The power access points supply power or access to ground. In a particular example, access points 1510 to a common electrical conduit can be provided on one side 1510 of the powered rail 1500, and access points to a separate electrical conduit, for example, a power supply or ground, can be provided on an opposite side of the powered rail 1500.

When not in use, a strip of insulator 1514 can be supplied to cover unused access points 1510. Optionally, the strip 1514 can include raised nodules 1516 that fit within the access points 1512.

Figure 16:
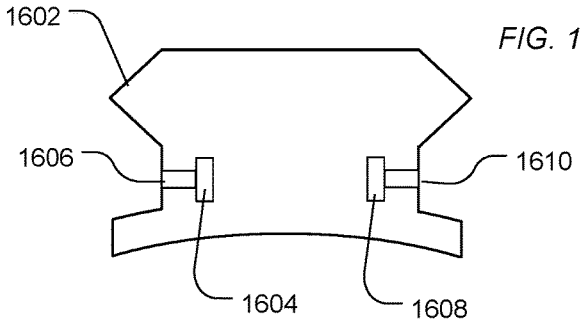
FIG. 16 includes a cross-sectional view of an exemplary powered rail.

When viewed in cross-section, as illustrated in FIG. 16, the powered rail 1602 can include a first electrical conduit 1604 extending along a first side of the rail 1602 and a second electrical conduit 1608 extending along a second side of the rail 1602. An access point 1606 can be provided to access the rail 1604. The access point 1610 can have similar configurations to the access point 1606. For example, the access points can be a hole, a clip disposed within a hole and connected to the respective rail or a solid conductor electrically connected to the respective rail. An exemplary hole or opening defining the access point 1606 or 1610 can be circular in shape. In another example, the hole or opening can be ovular, rectangular, square, or polygonal. In a further example, the hole or opening can taper as it extends toward the conduit 1604 or 1608. In an additional example, a compliant material or membrane can be disposed in the hole or opening, which opens to expose the conduit 1604 or 1608 in response to insertion of a pin or contact.

In a particular example, the access points 1606 or 1610 can be openings providing access to the rails 1604 or 1608 respectively. The openings can have a characteristic diameter defined as the square root of the cross-sectional area divided by pi (i.e., sqrt(A/pi)) of 0.15 mm to 2 mm, such as 0.25 mm to 1.5 mm or 0.5 mm to 1.25 mm. The openings 1606 or 1610 can have a depth of 0.15 mm to 6 mm, such as 0.15 mm to 3 mm or 0.5 mm to 2 mm. The openings 1606 or 1610, can have a circular cross-section. In another example, the openings 1606 or 1610 can have a cross-section of a polygonal shape, such as a triangle, a rectangle, a hexagon, or an octagon. In particular, the shape and diameter can be configured to limit water incursion into the opening based on surface tension at an air/water interface at the opening. Such exclusion of water can prevent unwanted current generation along the firearm and limit corrosion.

Figure 17:
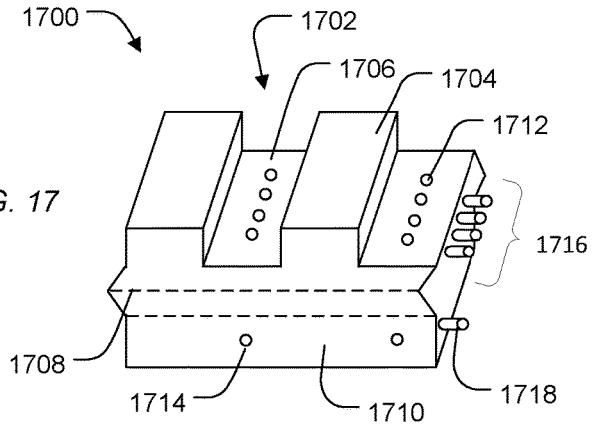
FIG. 17 includes an illustration of an exemplary control rail.

The control rail can include a plurality of attachment points. At the attachment points, the control rail can also include a control interface to provide electrical interaction between the control rail and the powered rails. For example, as illustrated in FIG. 17, the control rail can include a plurality of attachment points 1702. In the illustrated example, the attachment points 1702 can include at least one tooth 1704 and a depressed portion 1706. At one or more of the attachment points 1702, the control rail 1700 can include a control interface 1712. The control interface 1712 can include one or more contacts or electrical contacts. In an example, the contacts can be electrical contact pads. In another example, the contacts can be clips for receiving pins. In another example, the contacts can be access points similarly to the access points described above and optionally having similar dimensions and cross-section.

For example, the control interface 1702 can include a plurality of access points having a characteristic diameter of 0.15 mm to 2 mm, such as 0.25 mm to 1.5 mm or 0.5 mm to 1.25 mm. In a further example, the control interface access points can have a depth of 0.15 mm to 6 mm, such as 0.15 mm to 3 mm or 0.5 mm to 2 mm. Further, the control interface access points can have a circular cross-section. In another example, the control interface access points can have a cross-section of a polygonal shape, such as a triangle, a rectangle, a hexagon, or an octagon. In particular, the shape and diameter can be configured to limit water incursion into the opening based on surface tension at an air/water interface at the opening. Such exclusion of water can prevent unwanted current generation along the firearm and limit corrosion.

In an example, the interface 1712 can provide electrical interaction with a plurality of electrical conduits 1716 extending through the control rail 1700. For example, the interface 1712 is illustrated as being disposed on a top surface of the rail 1700 and the plurality of electrical contacts 1716 extend horizontally along the rail 1700 under the surface 1706. Alternatively, the control interface 1712 can be disposed on the top surface 1704.

Optionally, the control rail 1700 has a ridge 1708 around which the control attachments can be secured. Under the ridge 1708, the control rail 1700 includes a side surface 1710. Optionally, along the side surface 1710 at one or more of the attachment points 1702 are additional access points 1714. Such access points 1714 can be used to provide power to additional accessories attached to the control rail instead of the powered rails. Alternatively, the access points 1714 can provide access to a common electrical conduit. In an example, the access points 1714 provide connection to a select conduit 1718 extending along or under the surface of side surface 1710. For example, the conduit 1718 can extend in a manner similar to the rails 1604 or 1608 illustrated in FIG. 16.

In an alternative example, the control interface 1712 can be provided on one or both of the side surfaces of the control rail 1700. In such an example, multiple access points can be provided at each of one or more of the attachment positions 1702 along the side surfaces 1710 the control rail 1700.

Figure 18:
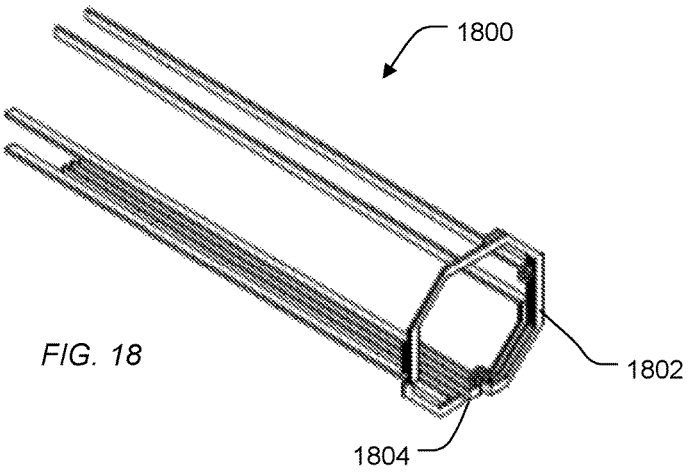
FIG. 18 includes an illustration of exemplary electrical conduits for powering a rail system.

FIG. 18 illustrates an exemplary configuration for the electrical conduits. In an example, an electrical conduit 1802 can provide a common electrical connection between the control rail and each of the powered rails. A set of additional electrical conduits 1804 can provide select electrical access to individual powered rails and optionally, the control rail. In an example, the common electrical conduit can be a ground conduit. In another example, the common electrical conduit can provide power and each of the individual electrical conduits 1804 can provide access to the ground when connected through a control circuitry. In particular, a rail mounting system can be molded or cast around the conduits.

Figure 19A:
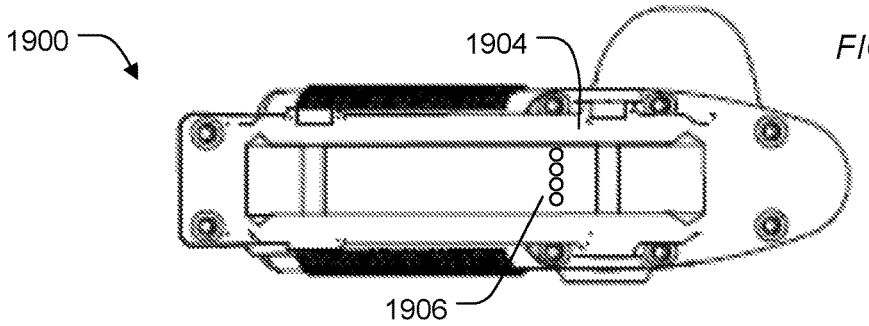
FIG. 19A and FIG. 19B include illustrations of an exemplary handle.
Figure 19B:
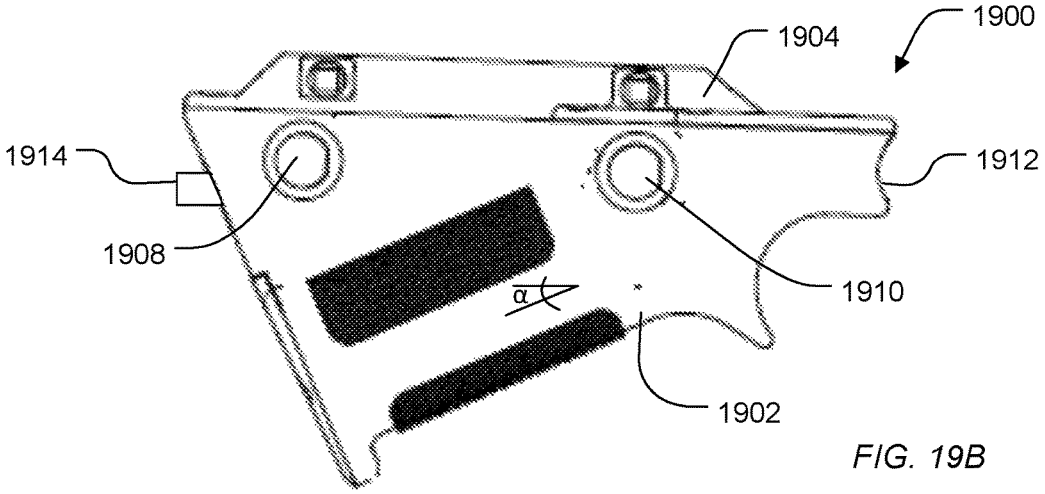
Figure 47:
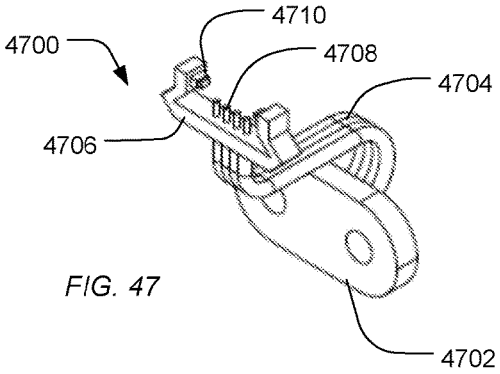
FIG. 47 includes an illustration of an exemplary interface device.

A power supply or control device can be connected to the control rail and electrically access the control interface. In a particular example, a handle that includes a power supply and control circuitry to control the control interface can be connected to the control rail. For example, as illustrated in FIG. 19A and FIG. 19B, a handle 1900 includes a grip 1902 that can interface with a hand and includes a rail interface 1904 to engage and attached to a control rail of a rail mounting system. In particular, the handle electrical interface 1906 is disposed as part of the rail mounting or attachment interface 1904. In an example, the handle control interface 1906 can include contact pads or pins, such as Pogo pins, to interact with the control interface of the rail mounting system. As illustrated, the handle control interface 1906 is positioned to interact with a control interface mounted on the surface of a control rail. Alternatively, the handle control interface 1906 can be disposed on one or both sides of the rail attachment interface 1904 interface with a side mounted control interface of a rail mounting system. Alternatively, as illustrated in FIG. 47, a handle control interface 4700 can be attached to a front of the grip. A grip connector 4702 can be connected to a rail interface 4706. The rail interface 4706 can include pins 4708 to control rails of the rail system and optionally can include pins 4710 to access the common or power connectors to the side of the control rail.

An exemplary handle 1900 includes an electronic interface, such as a mode select button 1908 and an activation button 1910. Optionally, the buttons (1908 and 1910) can be counter sunk. In another example, an additional activation button can be included on an opposite side of the handle 1900 as the mode select button 1908. In operation, the mode select button 1908 can be toggled between different modes providing power to select rails depending on the functionality of the mode select button 1908, and the activation button 1910 can be depressed to implement the mode selected using the mode select button 1908. Optionally, the handle 1900 can have an additional activation button positioned on the same side of the handle 1900 as the mode select button 1908 or on the opposite side of the handle of the mode select button 1908. In particular, the additional activation button can activate a different device than the activation button 1910. For example, the activation button 1910 can activate light devices based on the mode selected through the mode select button 1908, whereas the additional activation button can activate a different type of device or a device having significant consequences, such as a Taser device, for example, in response to selection of a Taser mode using the mode select button 1908. An exemplary handle can further include a front multi-pin electrical interface 1912 to provide a wired connection to a head mounted device that includes a plurality of light sources. In an example, the buttons can be counter sunk to prevent accidental activation.

In addition, the handle 1900 can include a programming or recharging interface 1914 that can access an external power supply or a computational device. For example, the computational device can be used to program the modes selectable using the mode select button 1908. In another example, the electrical interface 1914 can provide for recharging a power supply of the handle 1900. For example, the interface 1914 can allow for interaction with a battery, line power, solar power, or other power supply, or any combination thereof, to recharge or provide power to the handle 1900.

In a particular example, a lower surface of the handle 1902 configured to interface with the palm of the hand is disposed at an angle $\alpha$ relative to a horizontal plane of the rail to which the handle is attached. A select range of angles also provides for desirable positioning of the hand and activation of different muscle groups within the arm and can be selected to provide improved muscle control, recoil control, or reduce fatigue. In an example, the angle $\alpha$ is in a range of 5° to 60°, such as a range of 10° to 60°, a range of 10° to 45°, a range of 15° to 35°, or a range of 18° to 30°.

Figure 20:
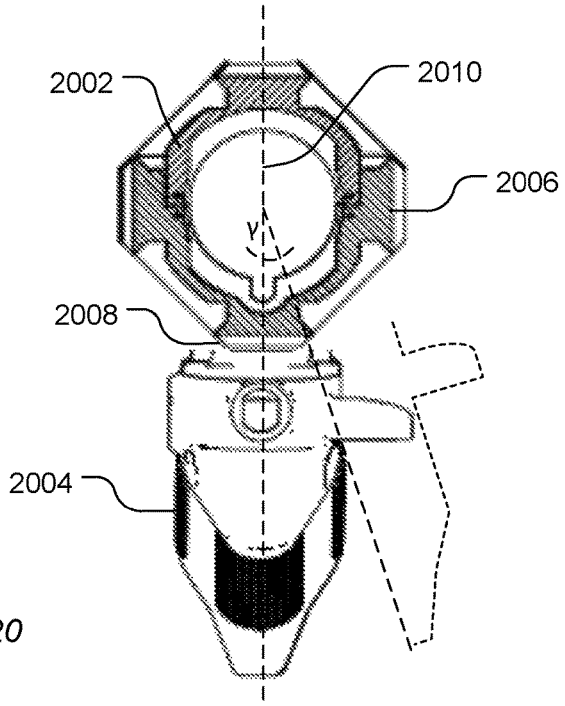
FIG. 20 includes an illustration of an exemplary handle attached to a rail system.

As illustrated in FIG. 20, the handle can extend down along a vertical axis of symmetry 2010. For example, a rail mounting system 2002 includes a plurality of powered rails 2006 and a control rail 2008. In the illustrated example, the control rail 2008 extends downward along the vertical axis of symmetry 2010. The handle 2004 can extend to have a center of gravity and a grip surface disposed below along the axis of symmetry 2010. Alternatively, the grip interface of the handle 2004 can have a center line disposed at an angular offset from the vertically extending axis of symmetry 2010. For example, the lower interface or grip interface of the handle 2004 can have a center axis that is at an angle $\gamma$ relative to the vertically extending axis of symmetry 2010 in a range of 0° to 45°, such as a range of 0° to 30°, a range of 5° to 25°, a range of 5° to 18°, or a range of 5° to 15°.

Figure 21:
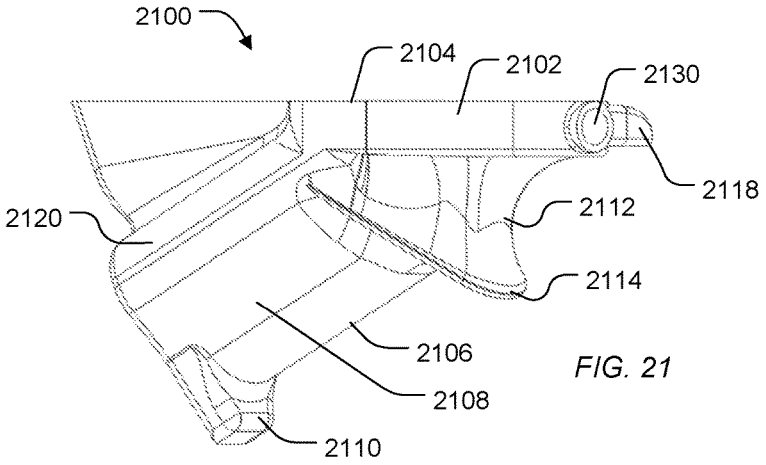
FIG. 21 includes an isometric view of an exemplary handle.
Figure 22:
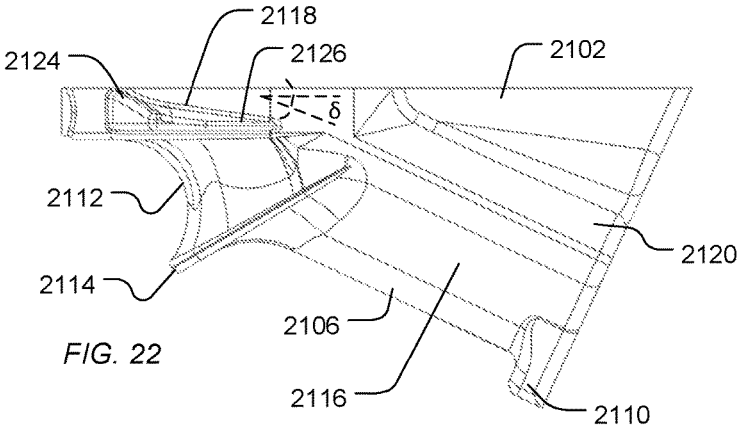
FIG. 22 includes a first side view of an exemplary handle.
Figure 23:
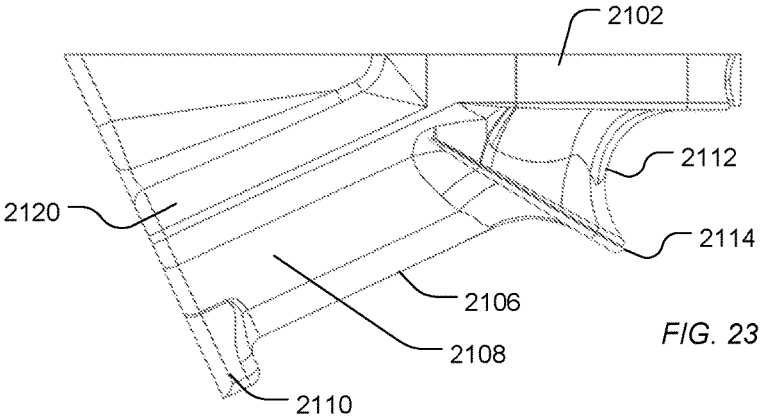
FIG. 23 includes a second side view of an exemplary handle.

In a particular example, the handle provides multiple contact surfaces which provide for improved control of the firearm using the leading hand and arm. For example, as illustrated in FIG. 21, FIG. 22, and FIG. 23, a handle 2100 includes a handle body 2102 with an upper surface 2104 to attach to a rail mounting system. In addition, the body 2102 can provide a lower contact surface 2106, side contact surfaces 2108 and 2116, an index finger contact surface 2112, and a thumb contact surface 2118. In addition, the handle body 2102 can include a contact surface 2110 to contact a side of the hand and can include curved upper contact surfaces 2120 to contact the tip of fingers or the hand at the base of the thumb. In a particular example, a ridge 2114 separates the contact surface 2112 for the index finger from the contact surfaces 2106, 2108, and 2116 to contact the palm of the hand.

The thumb contact 2118 can provide an upper surface onto which the thumb rests and can extend out from the body 2102 to define a protected recess that prevents the thumb from being readily struck from the side. The thumb contact 2118 can include a lower surface 2126 onto which a side of the thumb or the tip of the thumb rests and can optionally define a stop surface 2124 to be contacted by the tip of the thumb to signal positioning of the thumb or hand or to prevent access to the thumb from a forward position. In a particular example, the thumb contact 2118 can be placed at an angle $\delta$ relative to a horizontal place of the rail in a range of 0° to 45°, such as a range of 0° to 40°, a range of 5° to 40°, a range of 10° to 35°, a range of 10° to 30°, or a range of 20° to 30°.

In another embodiment illustrated in FIG. 24, FIG. 25, FIG. 26, FIG. 27, FIG. 28, and FIG. 29, a handle 2400 includes a handle body 2402 an upper attachment point 2404 for attaching to a rail mounting system. The body 2402 includes contact surfaces for the palm of the hand 2406, 2408, or 2416. One or more of the contact surfaces can be stippled, ribbed, or textured. The body 2402 can include an index finger contact surface 2412 separated from the palm contact surfaces 2406, 2408, and 2416 by a ridge 2414. Upper contact surfaces 2420 can be provided to contact the tip of fingers or the padding at the base of the thumb. Further, the body 2402 can include a contact surface 2410 to engage the side of the hand. In addition, the body 2402 can define a thumb rest 2418 that has a lower surface 2426 and a front upward extending surface 2424. One or more of the contact surfaces can be stippled, ribbed, or textured. For example, as illustrated, contact surfaces 2406 and 2420 can be stippled, ribbed, or textured.

Figure 24:
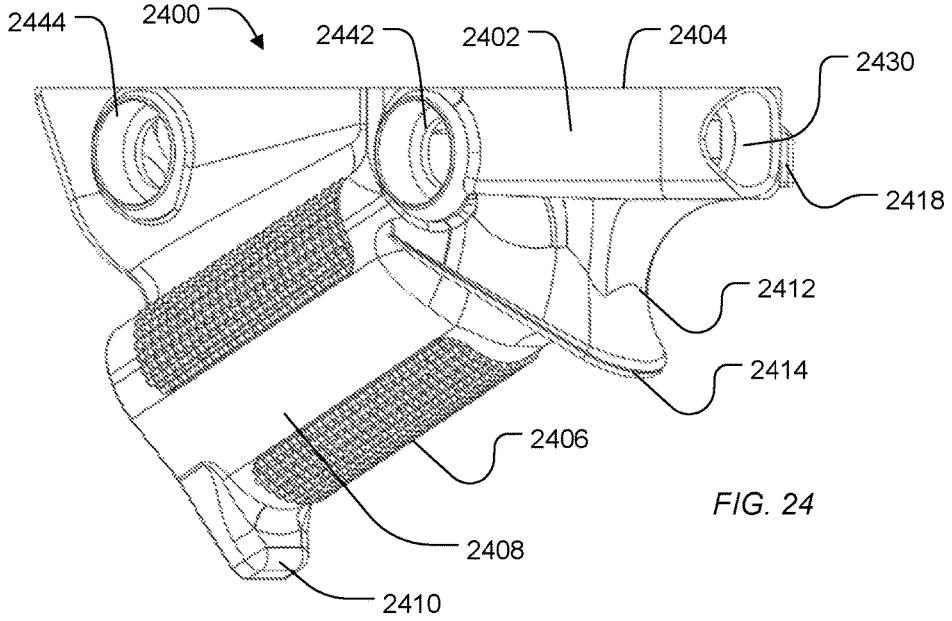
FIG. 24 includes an isometric view of an exemplary handle.
Figure 25:
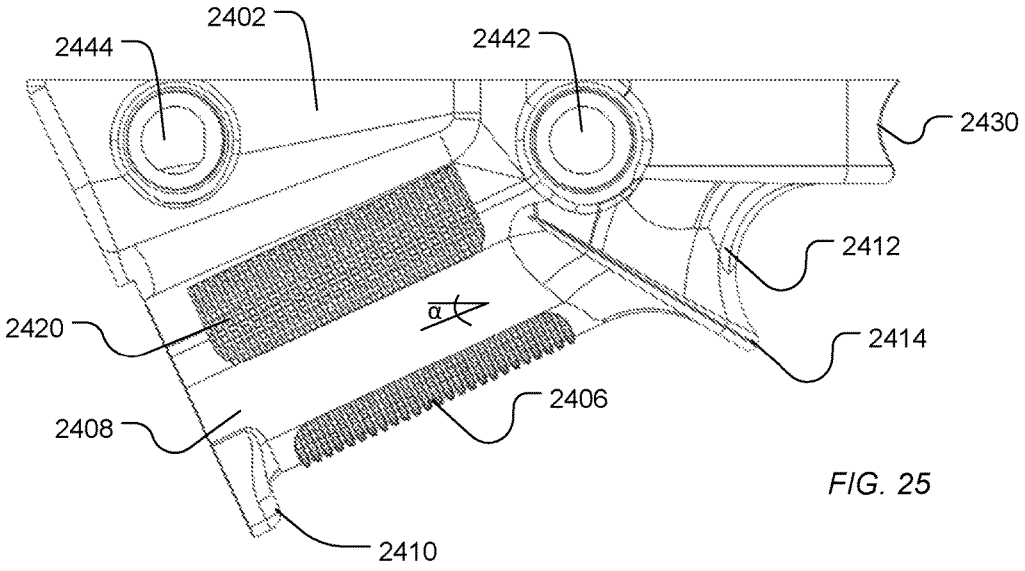
FIG. 25 includes a side view of an exemplary handle.
Figure 26:
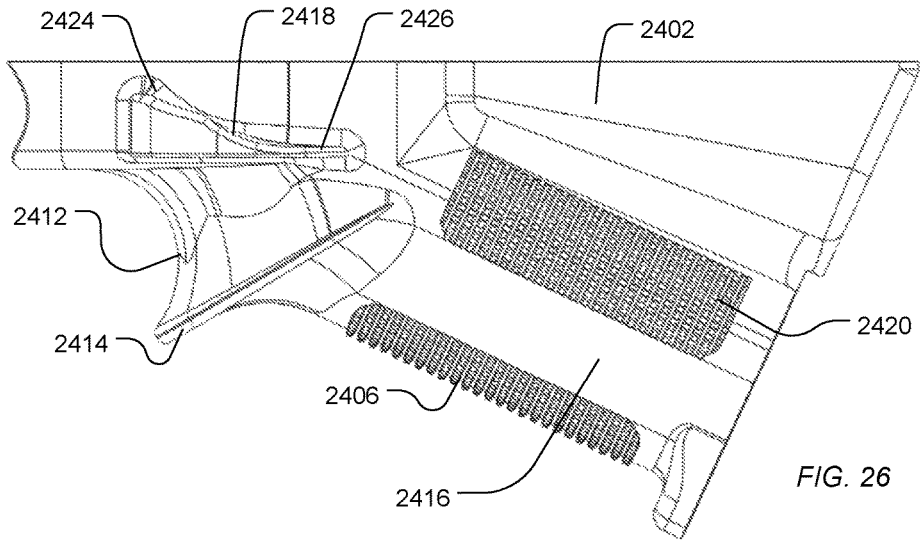
FIG. 26 includes another side view of an exemplary handle.
Figure 27:
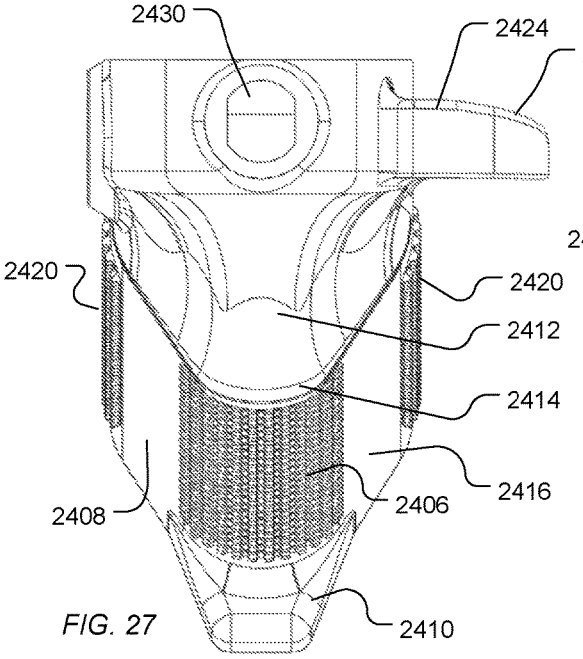
FIG. 27 includes a front view of an exemplary handle.

As illustrated in FIG. 24 and FIG. 25, the body 2402 can define openings for buttons 2442 and 2444 to provide functionality and control of auxiliary devices disposed or attached to a powered rail system. For example, the button 2444 can be a mode select button, allowing the selection of individual rails or the selection of an individual rail along with a desired power configuration or waveform. Once a mode is selected, the activation button 2442 can be applied to implement the selected mode.

While not illustrated, one or more signaling mechanisms can be utilized to indicate which mode is selected. For example, one or more LEDs can be disposed on the backside of the handle. Alternatively, a vibrational signal can be used. In another example, a sonic signal can be used to indicate the mode. In a particular configuration including an ordered set of modes, a single LED disposed at the back of the handle can blink a number of times to indicate which mode is selected. In another example, the handle can vibrate upon selection of the mode to indicate which mode is selected. In a further example, when a particular mode is selected, a sonic signal, such as an alarm, can sound from within the handle.

The handle can also include a multi-pin front interface 2430, such as a wired interface, to interact with a head device having multiple light sources or other attached devices. In a particular example, the multi-pin interface 2430 can be waterproof or water tight. Alternatively, the handle can be configured with an attachment point to or can be integrated with a structural extension to couple with a head device. In a particular example, the handle, extension, and head can be formed as a unitary piece, or in one or more sections.

Figure 28:
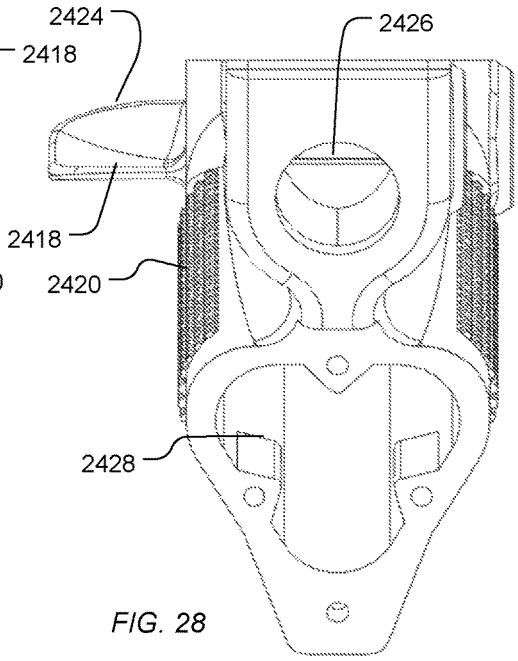
FIG. 28 includes a back view of an exemplary handle.
Figure 29:
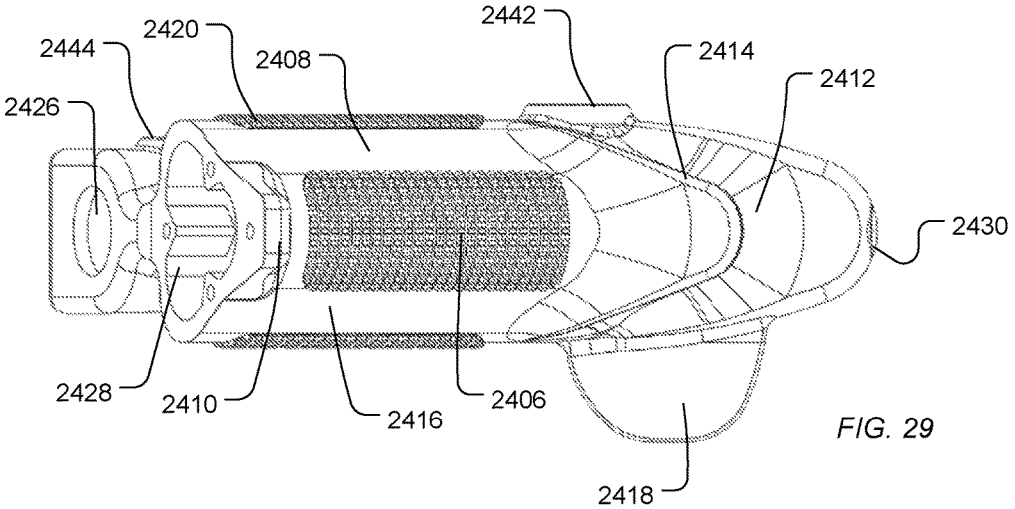
FIG. 29 includes a bottom view of an exemplary handle.

FIG. 28 illustrates a rear surface of the handle 2400. The rear surface shows an opening 2428 into which a power supply can be disposed. The opening or cavity 2428 can be isolated using a waterproof backing to be applied over the backside of the handle 2400. In addition, a rear electronic interface 2426 can be used to provide power or recharge the power supply and optionally program modes selectable using the mode select button 2444. The interface 2426 can be a simple wire interface for providing power. In another example, the electronic interface is a communication interface, such as a serial or parallel interface for providing programming or power. In an example, the interface 2426 can be a USB interface. In a particular example, the interface 2426 is water proof.

In particular, the location of the buttons and the contact surfaces of the handle can provide for binary mechanical action. Such binary mechanical action leads a user to disassociate actions by a forward hand from actions of the trigger hand and particularly the trigger finger, preventing accidental discharge of the weapon in stressful situations. In a particular example, a user twists the forward hand at least 10° (e.g., at least 15°), but generally not greater than 60°, from a grip position to access the buttons.

FIGS. 34-42 includes an illustration of an alternative example of the handle 3400. For example, the handle 3400 includes a handle body 3402 with an interface 3404 to a rail system. The handle 3400 also includes grip contact surfaces 3414 for hands. In addition, the handle 3400 includes an adjustable index finger insert 3412 insertable into an opening 3424 in the handle body 3402. The position of the index finger insert 3412 can be adjusted within the opening 3424 to suit a user's grip. In another example, the handle body 3402 can include openings 3410 to receive a thumb paddle 3406. The thumb paddle 3406 can include a guide 3408 to guide the paddle 3406 into position within thumb paddle openings 3410. As illustrated, the handle body 3402 includes thumb paddle openings 3410 on both sides of the body permitting positioning of the thumb paddle 3406 on the side of the handle body 3402 depending upon the handedness of a user or permitting thumb paddles on both sides of the body. In a particular example illustrated in FIG. 36, the thumb paddle 3406 can be positioned at different positions within the thumb paddle opening 3410 based on the location of pin holes 3626. The thumb paddle 3406 can be inserted into the opening 3410 to position a hole extending through the thumb paddle 3406 in alignment with the pin hole 3626 and a rod or post can be inserted through the thumb paddle 3406 and the pin hole 3626.

On either side or both, the handle body 3402 can include guide interfaces 3416 to receive a pressure pad keeper 3418. In the case of both sides including the guide interface 3416, an additional panel 3420 can be included that does not have pressure pad keeper features. Optionally, a backplate 3422 can be applied to further secure the pressure pad keeper 3418 or panel 3420 within the guide interface 3416. Optionally, the handle body 3402 can be hollow and the backplate 3422 can secure items within the hollow body 3402 of the handle 3400. In an example illustrated in FIG. 38, the pressure pad keeper 3418 includes a window 3828. A pressure pad can be inserted between the guide interface 3416 and the pressure pad keeper 3418 and optionally secured within the pressure pad keeper 3418 using a screw or other mechanism. The pressure pad can be accessible, for example to turn an accessory device on or off through the window 3828.

Figure 43:
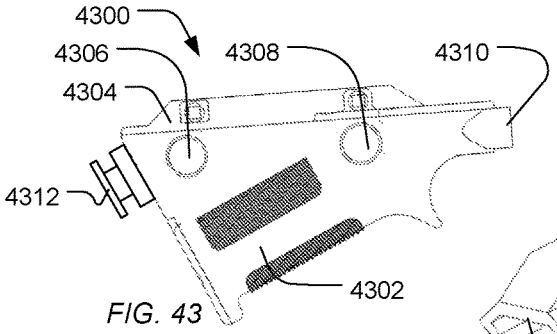
FIG. 43 includes an illustration of an exemplary handle.
Figure 44:
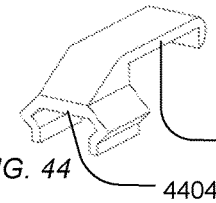
FIG. 44 includes an illustration of an exemplary clip.
Figure 45:
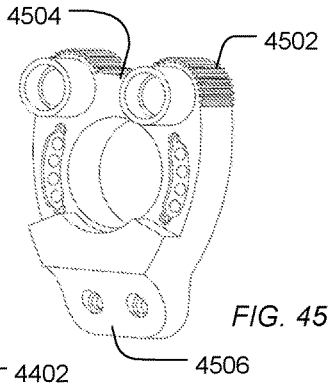
FIG. 45 includes an illustration of an exemplary head.
Figure 46:
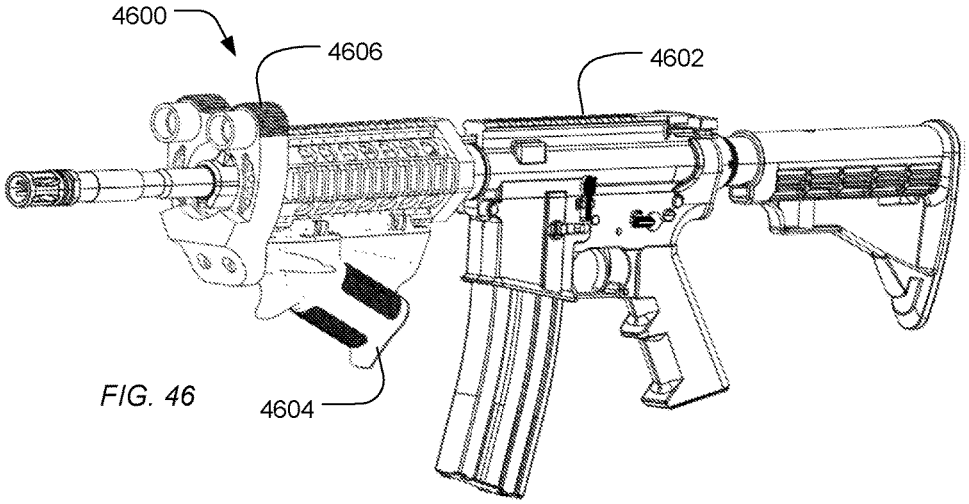
FIG. 46 includes an illustration of an exemplary assembly.

For example, in an alternative example illustrated in FIGS. 43-45, a lighting system and handle can be configured to interface without a wire extending between the handle and light source. For example, the handle 4300 includes a handle body 4302 with a front interface 4310 and a rail interface 4304. Optionally, the system includes a rear communications interface 4312 and includes buttons, such as a mode select button 4306 and an activation button 4308. The front interface 4310 of the handle body 4302 can both mechanically and electronically interface with the head 4502 as illustrated in FIG. 45. The interface 4506 includes both mechanical and communications interfaces to the handle. As illustrated in FIG. 44, a clip includes a front portion 4402 to engage a top side 4504 of the head 4502 and includes a rail interface 4404 to engage a rail system. When assembled, as illustrated in FIG. 46, the system 4600 includes a firearm 4602 and the handle 4604 connected directly to a head 4606 and to a rail system.

Figure 50:
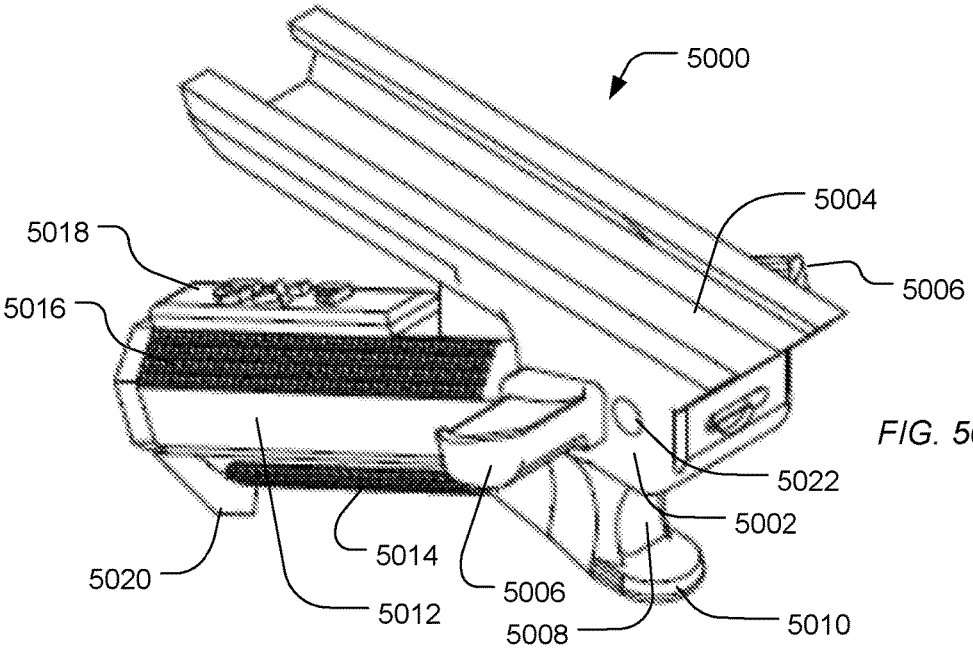
FIG. 50, FIG. 51, and FIG. 52 include illustrations of an exemplary handle.
Figure 51:
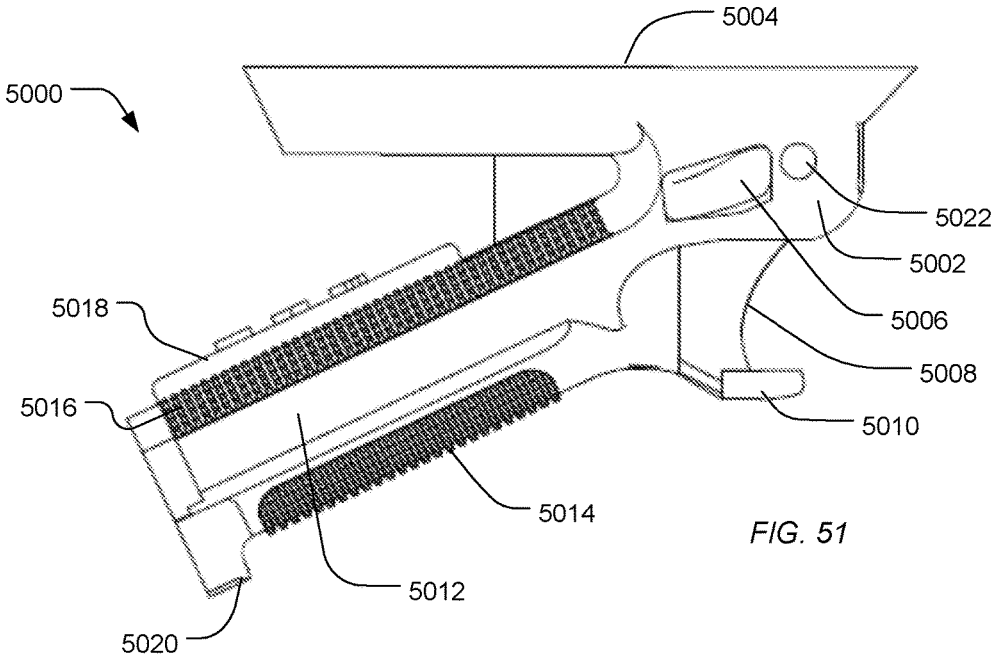
Figure 52:
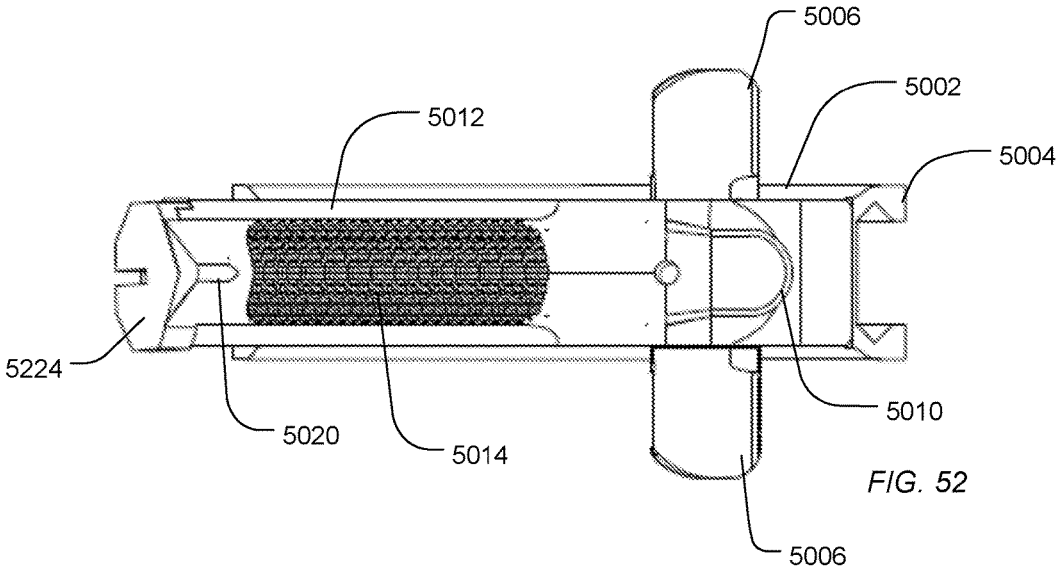

In a further exemplary embodiment illustrated in FIG. 50, FIG. 51, and FIG. 52, a handle 5000 includes a body 5002 coupled to or integrated with an interface 5004. The interface 5004 can engage a handguard or forestock of the firearm, for example, a rail mounting system, such as a Picatinny rail mounting system, Key Mod™ system, another rail mounting system, or any combination thereof. The body 5002 can further define a grip post 5012 extending downward and rearward relative to the interface 5004.

One or more thumb paddles 5006 can extend from sides of the body 5002. In an example, thumb paddles 5006 can include posts that engage openings 5022 within the body 5002. For example, a thumb paddle 5006 can selectively engage an opening 5002 at one or more positions along the body 5002. The handle 5000 can include a single thumb paddle 5006 or, as illustrated, can include two thumb paddles 5006 extending from opposite sides of the body 5002. In a further example, the thumb paddle 5006 can be rotatable, for example, along an axis of the post that engages the openings 5022.

The body 5002 can further define an index finger grip surface 5008. The index finger grip surface 5008 can optionally be movable between one or more select positions. The index finger grip surface 5008 can be separated by a ridge 5010 from the rearward and downward extending grip post 5012.

The grip post 5012 can include a lower grip surface 5014 and one or more upper grip surfaces 5016 to engage the palm or one or more additional fingers of the hand. The grip post 5012 can include a barrier structure 5020 extending downward from a distal end of the grip post 5012. The barrier structure 5020 can engage the rearward surface of a finger engaging the grip post 5012.

The handle 5000 can include electronic interfaces, such as buttons, activators, or pressure pads. In an example, the electronic interfaces can be disposed on a top surface of the grip post 5012. As illustrated, a pressure pad activator 5018 is disposed on the top surface of the grip post 5012. Alternatively, one or more buttons, such as mode select or activator buttons can be disposed on the top surface of the grip post 5012. Further, the grip post 5012 includes an opening to receive electronics or other tools and devices. The opening can be secured or closed using an end cap or cover plate 5224.

An exemplary thumb paddle is illustrated in FIG. 53 and FIG. 54. The thumb paddle can include a main body 5302 to receive a thumb and can include a post 5304. A top surface 5308 of the body 5302 can be configured to receive a thumb and can be concave. A forward ridge 5312 optionally extends higher than the surface 5308. Proximal to the post 5304, a ridge 5316 can restrict movement of the thumb towards the body of the handle. At an edge distal form the post, a ridge 5314 can guide the thumb to remain in position on the surface 5308. The thumb paddle body 5302 can also include an under side 5310 that is flat or convex. The post 5304 can include an interface, such as an opening to receive a pin, to secure the thumb paddle to the handle.

In an exemplary embodiment, the index finger grip can be adjustable to extend outward from the body or be drawn into the body of the handle, depending upon the user's preference. In an example, an insert 5502 can define a front surface 5504 to receive an index finger. One or more positioning posts 5506 or 5508 can extend into the body of the handle and can be secured in place at selective positions based on openings 5510 to receive a locking bolt, pin or screw.

An exemplary cover plate 5602 to cover a distal end of the grip post is illustrated in FIG. 56 and FIG. 57. In an example, the cover plate 5602 includes a front surface 5604 and a slot 5606 to receive wires of electronics, such as a pressure pad. As illustrated in FIG. 57, the cover plate 5602 can include a recess 5708 and can include structures 5710 to engage a pressure pad activator.

As illustrated in FIG. 58 and FIG. 59, a pressure pad activator 5802 includes structures such as posts 5804 to align the pressure pad activator, as well as a front ridge 5810 to engage the handle and a back ridge 5812 to engage the cover plate. Optionally, structures 5804 can be formed of resilient material or can include springs. The activator 5802 can include a pinch structure 5806 to apply pressure to the pressure pad when pressure is applied downward from a top surface of the pressure pad actuator 5802.

In use, the handle or grip permits positioning of the thumb, index finger, and remaining fingers at positions advantageous for controlling and manipulating a firearm. In particular, the thumb can be positioned approximately parallel with the barrel and positioned under or below the barrel in relative height. Further, the positioning of the thumb paddle in relation to the handguard places the thumb in a recess defined between the thumb paddle and a lower surface of the handguard or rail system. Such positioning of the thumb provides advantageous protection for the thumb and further control of the barrel position. The positioning of the index finger and the remaining fingers of the hand allow the arm to be in an approximately neutral, although partially supinated position. Together, the grip permits a greater range of motion left and right when aiming the firearm, better control of the firearm using the less dominant hand, and manipulation of the firearm using the less dominant hand without maintaining contact with the more dominant hand. In particular, the three points of compression in the described configuration proves control of dragging weight and barrel curl and is particularly useful for controlling muzzle rise of the firearm when in use by a weaker individual or child. As such, the handle or grip provides for greater safety. Further, the less dominant hand can rotate the weapon and provide control of the weapon during a dominant hand magazine change. Embodiments including adjustable or rotatable thumb paddles provide for improved handling of the weapon at different firing speeds. Further, control by the less dominant hand can free the more dominant hand during hand-to-hand combat or allow quick switching between lethal and nonlethal force when approach by an assailant. The low-profile of the handle along the sides provides less loss of peripheral vision, fewer blind spots and limits the risk of the handle catching on a corner or an article of clothing or strap.

Figure 30:
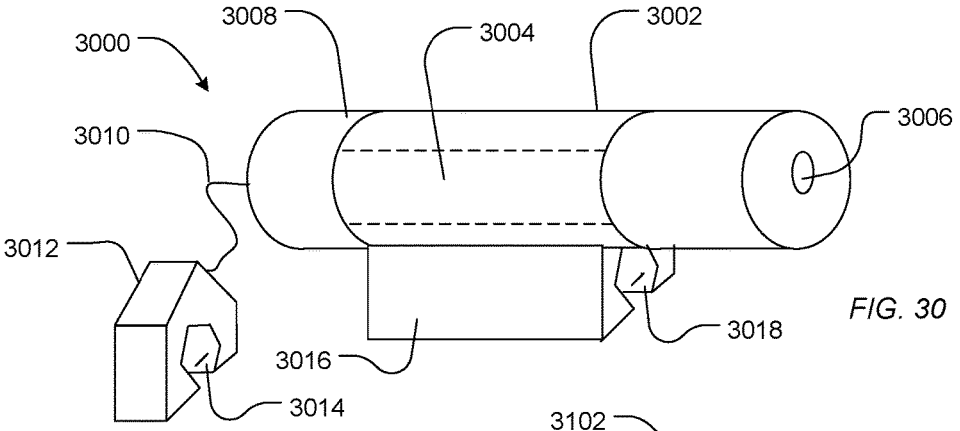
FIG. 30 includes an illustration of an exemplary accessory device.

The handle, when connected to a powered rail system, can control auxiliary devices attached to a powered rail or optionally to a control rail. For example, as illustrated in FIG. 30, an exemplary auxiliary device 3000 can be coupled to a rail of the powered rail mounting system and can be controlled using the handle. Exemplary auxiliary devices include visible light sources, infrared light sources, laser sources, cameras, Tasers, or any combination thereof. In the illustrated auxiliary device 3000, a device body 3002 includes a power circuitry 3004. The circuitry 3004 can be utilized to control the auxiliary device 3000, such as to control a light source 3006. In an example, the body 3002 is coupled to a rail interface 3016 allowing the device 3000 to be coupled to a rail of the rail mounting system. In an example, the rail interface 3016 includes pins 3018 extending from a side of the opening of the interface 3016 attached to the rail mounting system. The pins 3018 can engage access points disposed along sides of a powered rail. The pins 3018 can provide power to the circuitry 3004 and control the operation of the light source 3006.

In an alternative example, an interface 3008 can interface with a separate rail attachment interface 3012 that can attach to an access point of the rail. For example, pins 3014 can couple with the access points on the sides of the powered rail to provide power through the wired connection 3010 to the interface 3008 and circuitry 3004.

Figure 31:
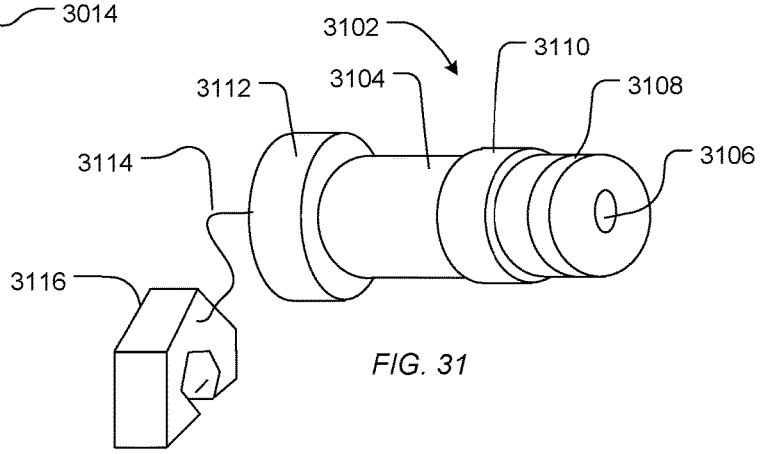
FIG. 31 includes an illustration of exemplary adapter unit for an auxiliary device.

To modify existing auxiliary devices for use with the rail mounting system, an adapter can be provided which replaces power supplies or batteries of rail mounted auxiliary devices with an adapter that draws power from the powered rail system. For example, as illustrated in FIG. 31, an adapter 3102 imitating a battery can include a central structure 3104 having disposed thereon contacts 3106 or 3108 which imitate battery contacts to electrically couple with an existing auxiliary device. In an example, a first contact 3106 can be disposed at a front of the structure 3104. A second contact 3108 can be disposed along the circumference towards the front or rear depending upon the configuration of the power supply utilized by the existing auxiliary device. Alternatively, both contacts 3106 and 3108 can be disposed at a front, rear or along the side of the auxiliary device depending on the configuration of the power supply of the auxiliary device.

In addition, one or more seals 3110 can be disposed along the structure 3104 to provide a water-tight seal or to provide spacing between the structure 3104 and side walls of the cavity of the auxiliary device into which the power supply was previously inserted. A rear connector 3112 can provide for a tight seal to the back of the auxiliary device and optionally replace a cap or plates, providing watertight seals to the power supply compartment of the auxiliary device. In an alternative example, a kit can be provided to adapt an existing cap or backplate to receive the structure 3104 and associated wiring (e.g., wire 3114).

An interface 3116 includes pins to attach to access points of the powered rail. The pins can provide power through the electrical conduit or wire 3114 to the adapter 3102, which provides power to the auxiliary device.

Figure 48:
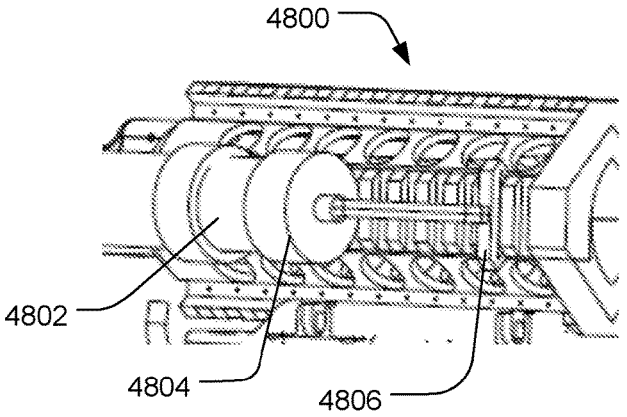
FIG. 48 includes an illustration of an exemplary accessory.
Figure 49:
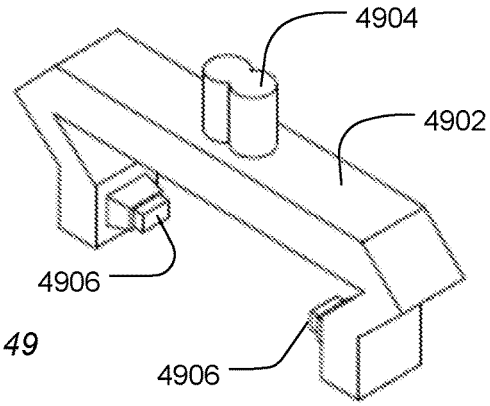
FIG. 49 includes an illustration of an exemplary accessory rail interface.

FIG. 48 and FIG. 49 illustrated an alternative example of an accessory adapter for the powered rail system. For example, as illustrated in FIG. 48, a system 4800 includes an accessory 4802, such as a flashlight, that receives a modified powercore 4804 that is attached by wire to an electrical rail interface 4806. In the example illustrated in FIG. 49, an electrical rail interface 4902 includes pins 4906 to electrically couple the wires 4904 to the powered rail system.

In a particular example, the rail mounting system can be utilized to control a variety of auxiliary devices connected to the rail, a head device disposed at a front position of the firearm, or one or more additional devices attached to the head device. Controls disposed on the handle can be utilized to select which devices to activate and deactivate, as well as provide power to the devices. In an example, the handle can include control circuitry that is programmable to include different modes in a selectable order.

Figure 32:
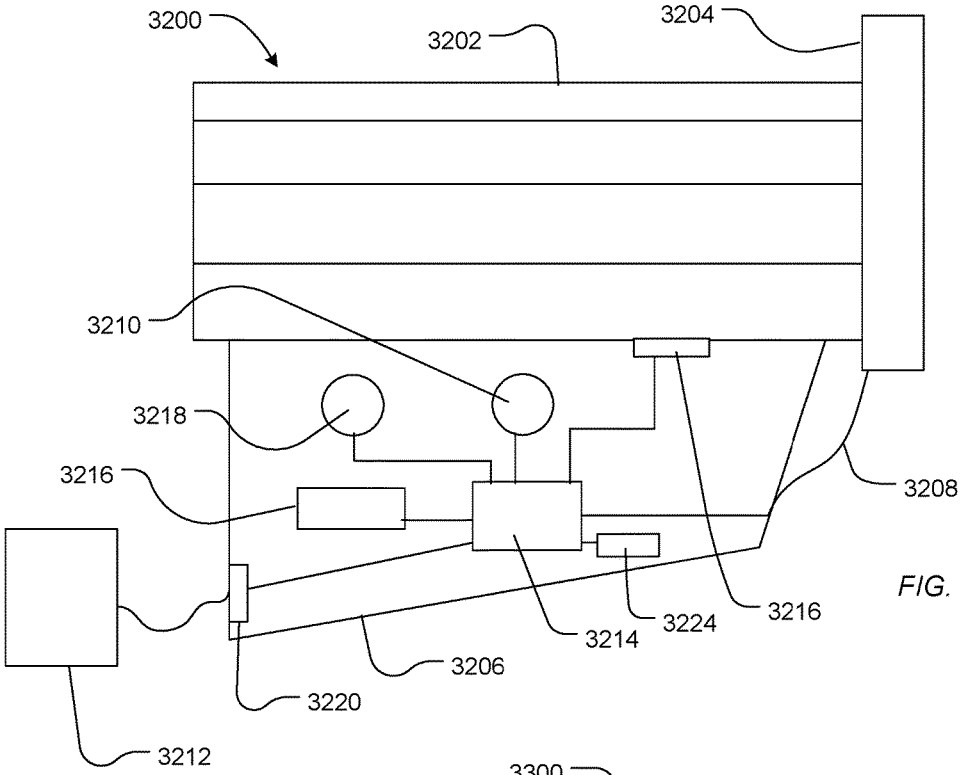
FIG. 32 includes an illustration of an exemplary powered rail system.

For example, as illustrated in FIG. 32, a rail mounting system 3200 includes a powered rail system 3202, optionally a head device 3204, and a control handle 3206. The control handle 3206 includes an electronic interface to the powered rail system 3202 and optionally, a separate interface 3208 to the head device 3204.

In a particular example, the handle 3206 includes a control circuitry 3214 and a power supply 3216. The control circuitry 3214 can interface with a power supply 3216. Depending upon the mode selected, the control circuitry 3214 can provide power through one or more interfaces 3216, 3208 or 3220 to control auxiliary devices or head devices. For example, a mode select button 3218 and an activation button 3210 can be electronically connected to the control circuitry 3214. Activation of the mode select button 3218 can permit the control circuitry 3214 to toggle between modes, and selection of the activation button 3210 can result in implementation of the selected mode through the control circuitry 3214, providing power in a particular configuration and waveform through interfaces 3216 or 3208 to the powered rail 3202 or the head device 3204, respectively.

In a particular example, the control circuitry 3214 is programmable through interface 3220. For example, computational device 3212 can access the control circuitry 3214 through the interface 3220 to provide programming to the control circuitry 3214. In particular, the computational device 3212 can provide a variety of mode configurations and a programmed order of modes to the control circuitry 3214, as well as a type of signal to use in signaling the transition between modes, such as using lights, vibration, or sound. In another example, the computational circuitry 3212 can access the control circuitry 3214 to access data stored with the control circuitry 3214 or on auxiliary devices. For example, a camera mounted to the powered rail system 3202 or the head device 3204 can provide picture or video data through the control circuitry 3214 to the computational circuitry 3212 via the interface 3220.

Alternatively or in addition, the handle 3206 can include a wireless communication circuitry 3224 in communication with the control circuitry 3214. The wireless communication circuitry 3224 can provide for wireless communication with the computational device 3212 or other devices. In an example, the wireless communication circuitry 3224 can be configured to communicate over telecommunications bands in accord with a communications protocol or based on a proprietary protocol. For example, the communication circuitry 3224 can be configured to interact with 802.11x compliant networks. In particular, the communication circuitry 3224 can access Bluetooth™ or Wi-Fi networks. In an additional example, the communication circuitry can communicate with GPS systems, satellite uplinks, cellular networks, or other communications systems. In a particular example, the communication circuitry 3224 can communicate with devices associated with the head device 3204.

Optionally, power can be provided through the interface 3220 either from or to the power supply 3216 via the control circuitry 3214. For example, an external power source can be used to recharge the power supply 3216 through the interface 3220. In an alternative example, an external device can be powered by the power supply 3216 utilizing the control circuitry 3214 and the interface 3220. For example, a handheld device, such as a mobile phone, mobile radio, GPS locators, or camera, can optionally be powered from the power supply 3216.

The control circuitry 3214 can further provide a signal indicating a level of power available in the power supply 3216. For example, the control circuitry can illuminate a light emitting diode (LED) in the back of the handle to indicate when power supply is low or providing an indication of the level of power available from the power supply 3216.

Figure 33:
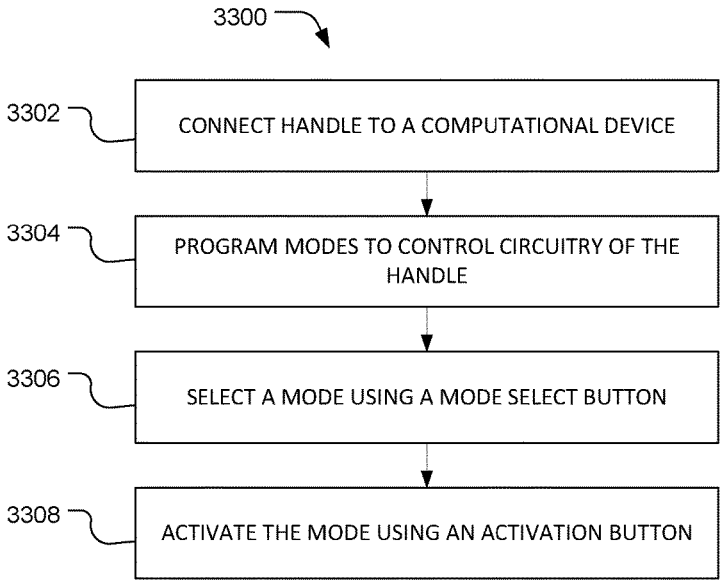
FIG. 33 includes an illustration of exemplary method for using a powered rail system.
Figure 34:
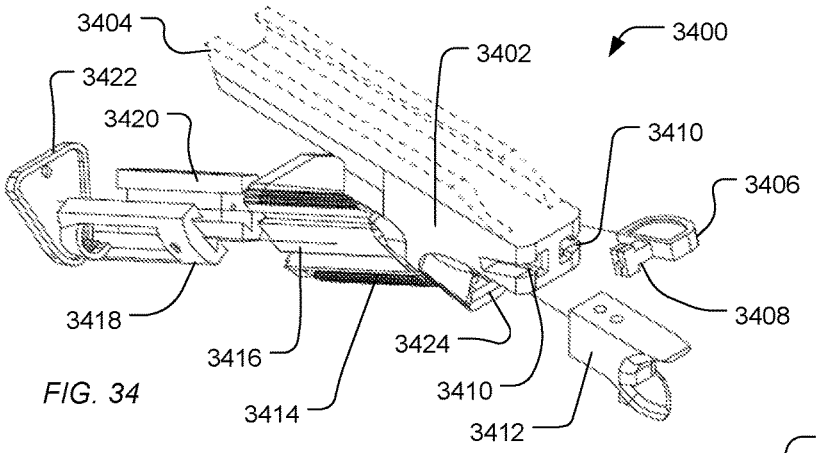
Figure 35:
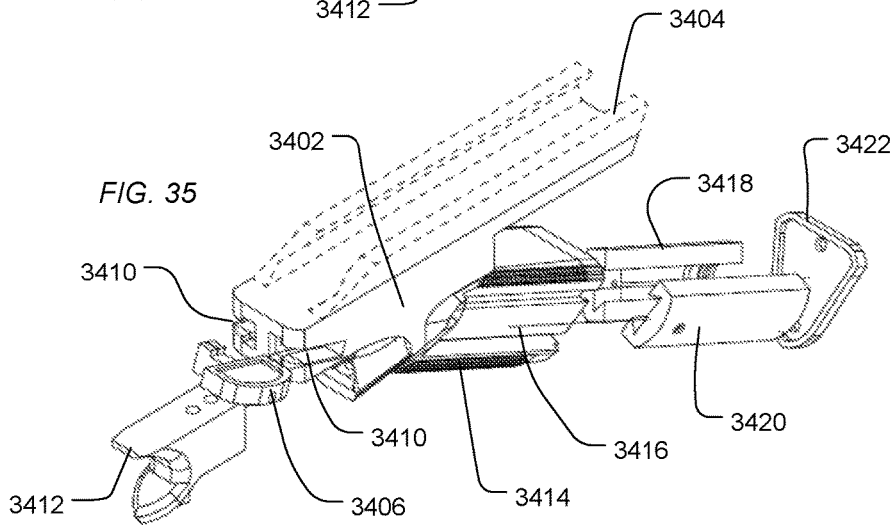
Figure 36:
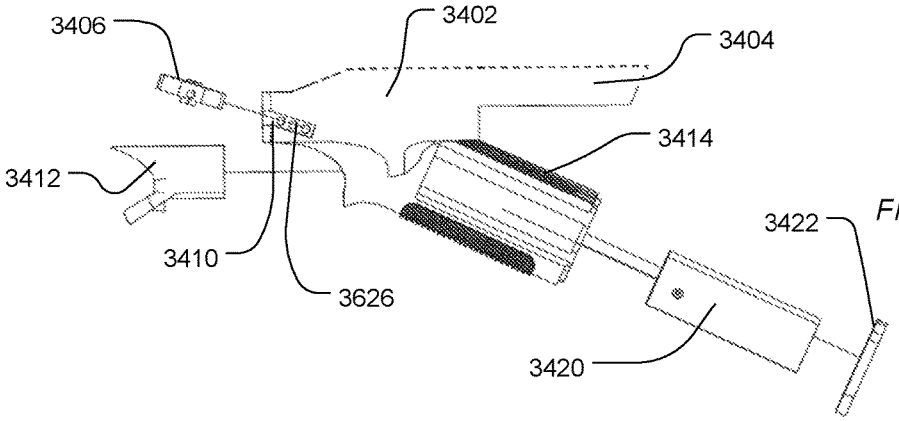
Figure 39:
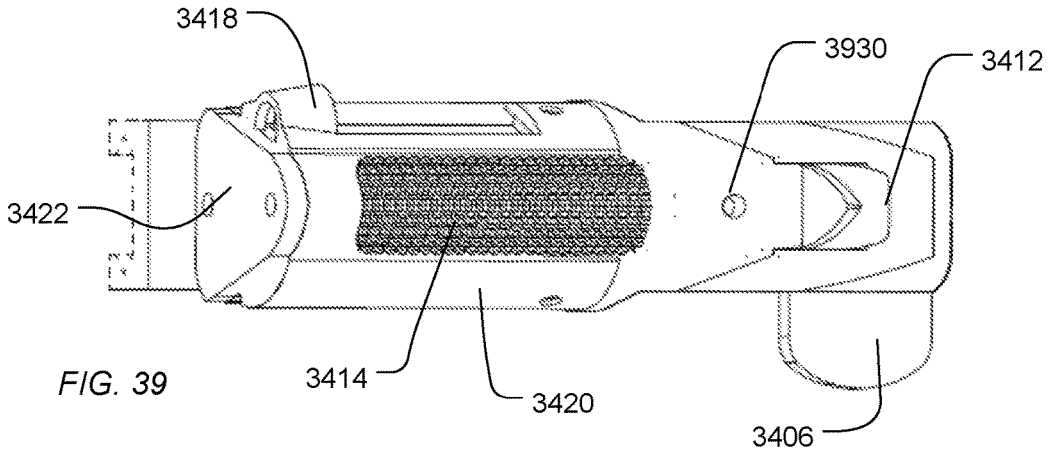
Figure 40:
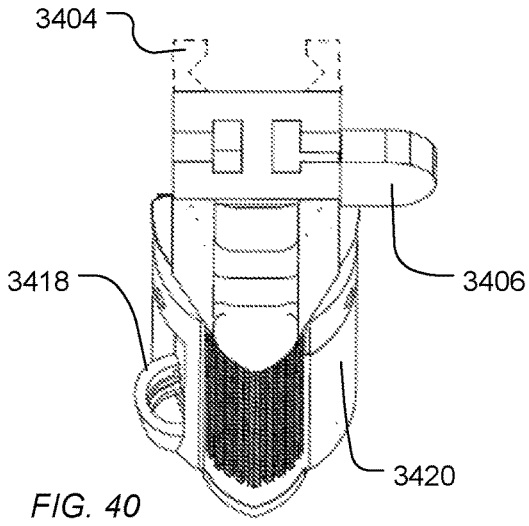
Figure 41:
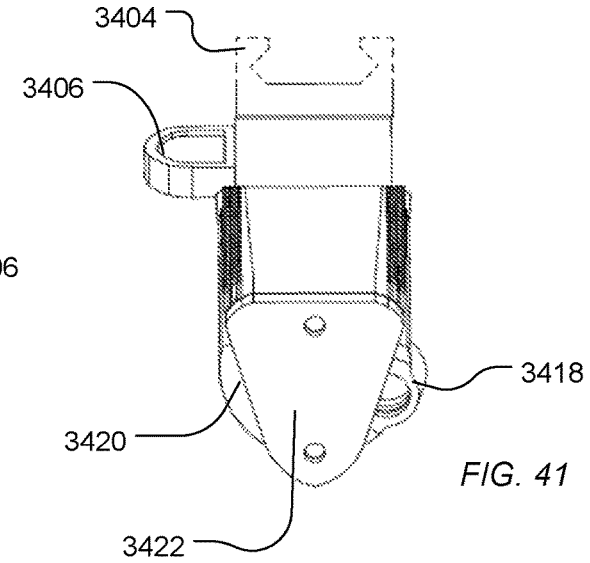
Figure 42:
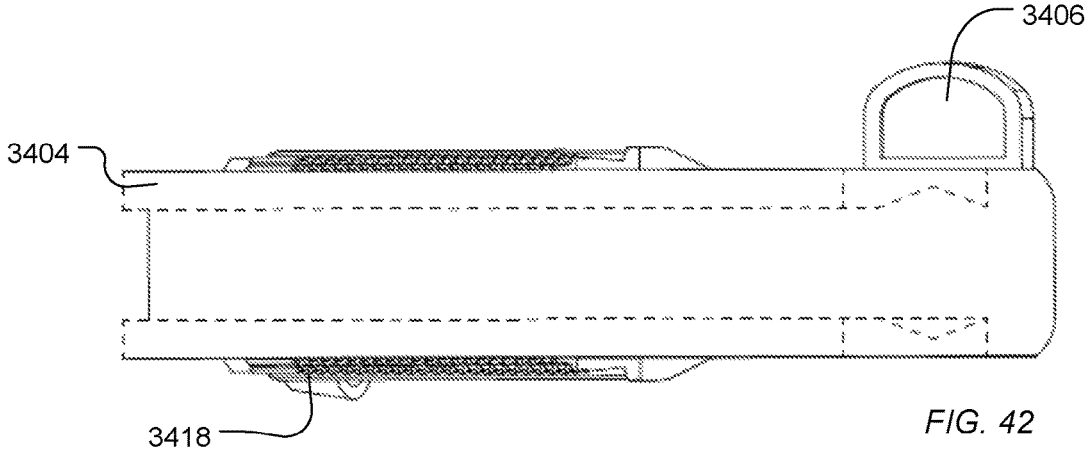

For example, as illustrated in FIG. 33, a method 3300 includes connecting the handle to a computational device, as illustrated at 3302. The computational device can communicate with a control circuitry of the handle providing power, providing programming, or retrieving data from the control circuitry of the handle.

As illustrated at 3304, the computational device can provide modes to the control circuitry of the handle. For example, the computational device can provide an ordered set of power settings to be utilized by the control circuitry of the handle in response to application of the mode select button. Each power setting can include a power configuration, such as a voltage and waveform, to be provided to a select rail, as well as optionally providing for a time period over which the power settings are to be supplied to the rail. In another example, a power setting included within the ordered set can include power settings for light sources or devices disposed on the head device.

In addition, the programming can include an indication of how users are to be signal once a select mode is selected. For example, the programming can include an indication of LED signals to be displayed to the user, vibrational settings, or alarms that can be activated in response to selection of a particular mode within the ordered set of power settings.

As illustrated at 3306, a user can select a mode by activating the mode select button. Optionally, the control circuitry can notify the user of the selected mode and the user can toggle through modes by repeatedly selecting the mode select button. Once the user has selected a mode, the user can then activate the select mode, as illustrated at 3308, via application of the activate button. In response to application of the activate button, the control circuitry can implement the select mode, for example, power can be supplied to a select rail for a select period of time.

In a first aspect, a mounting system for a firearm is described. The firearm includes a grip, a trigger, a cartridge, and a barrel, and a distal end of the barrel defining a front end of the firearm. the mounting system includes a rail assembly extending along the barrel and positioned forward of the grip, trigger, and cartridge, the rail assembly including a plurality of accessory rails and a control rail; a handle attached to the control rail at a position forward of the trigger, the handle comprising a power supply and a mode switch; and a head assembly mounted to the rail assembly proximal to the front end of the firearm and in electronic communication with the handle, the head assembly including two optical devices operable to project different spectrum, the mode switch operable to selectively enable operation of a select optical device of the two optical devices.

In an example of the first aspect, the control rail and handle are disposed under the barrel.

In another example of the first aspect and the above examples, the control rail includes a plurality of attachment positions, each attachment position including an associated rail control interface, the handle including a handle control interface to interface with the rail control interface. For example, the handle is removably attachable at each of the attachment positions. In another example, the rail control interface includes a common element and a set of control elements, a control element of the set of control elements uniquely associated with an accessory rail of the plurality of accessory rails. For example, the control rail at each of the attachment positions includes a first side access element electrically coupled to the common element and a second side element electrically coupled to a control element of the set of control elements.

In a further example of the first aspect and the above examples, each accessory rail of the plurality of accessory rails includes a plurality of access positions, each access position of the plurality of access positions including a first side access element electrically coupled to the common element and a second side access element electrically coupled to the control element uniquely associated with the each accessory rail. For example, the mounting system can further include an accessory device mechanically coupled to an accessory rail of the plurality of accessory rails at an access position of the plurality of access positions and electrical coupled to the first and second access elements. For example, the handle further includes an activation switch, the accessory device activated by selection of the mode switch followed by selection of the activation switch. In another example, the accessory device includes a light source. In an additional example, the each accessory rail includes a first side power rail shielded by an exterior of the each accessory rail, the each accessory rail including an opening at each access position exposing the first side power rail to define the first side access element.

In a further example of the first aspect and the above examples, the each accessory rail includes a second side power rail shielded by an exterior of the each accessory rail, the each accessory rail including an opening at each access position exposing the second side power rail to define the second side access element. In another example, the opening has a characteristic diameter in a range of 0.15 mm to 2 mm. For example, the characteristic diameter is in a range of 0.25 mm to 1.5 mm. In another example, the characteristic diameter is in a range of 0.5 mm to 1.25 mm.

In a further example of the first aspect and the above examples, the opening has a depth between an outside surface of the exterior of the accessory rail and the power rail in a range of 0.15 mm to 6 mm. For example, the depth is in a range of 0.15 mm to 3 mm. In another example, the depth is in a range of 0.5 mm to 2 mm.

In an additional example of the first aspect and the above examples, the rail assembly includes a rim structure housing electrical interconnects extending between the control elements and the first and second access elements of each accessory rail.

In another example of the first aspect and the above examples, the plurality of accessory rails have a Picatinny configuration In a further example of the first aspect and the above examples, the plurality of accessory rails have a KeyMod configuration.

In an additional example of the first aspect and the above examples, the control rail has a Picatinny configuration.

In another example of the first aspect and the above examples, the handle has a grip extending at an angle in a range of 10° to 60°. For example, the angle is in a range of 10° to 45°. In another example, the angle is in a range of 15° to 35°. In an additional example, the angle is in a range of 20° to 30°.

In a further example of the first aspect and the above examples, the handle includes a head interface and the head includes an electrical interface, the handle interface connected to the head interface by a cable.

In an additional example of the first aspect and the above examples, the head includes a rail electrical interface, the head to electrically connect to the handle via the control rail or an accessory rail of the two accessory rails.

In a second aspect, a mounting system for a firearm is described. The firearm includes a grip, a trigger, a cartridge, and a barrel, a distal end of the barrel defining a front end of the firearm. The mounting system includes a rail assembly extending along the barrel and positioned forward of the grip, trigger, and cartridge, the rail assembly including a plurality of rails extending in the direction of the barrel and distributed around the circumference of the barrel, the plurality of rails including a control rail and a set of accessory rails, the control rail including a plurality of attachment positions, each attachment position including a plurality of contacts accessible to a power supply, the plurality of contacts including a common contact and contacts uniquely associated with and in electrical communication with each of the set of accessory rails, the set of accessory rails each including a plurality of access points that each includes a first electrical access at a first side position of the each rail in electrical communication with the associated contact and a second electrical access at a second side position of the each rail in electrical communication with the common contact of the control rail.

In an example of the second aspect, the associated contact is electrically coupled to the first electrical access and the common contact is electrically coupled to the second electrical access via conductive elements disposed in a rim structure disposed at an end of the rail assembly.

In another example of the second aspect and the above examples, at each attachment position, the control rail includes a third electrical access at a first side of the power rail and a fourth electrical access at a second side of the power rail, the third electrical access in electrical communication with an associated power rail contact and the fourth electrical access in electrical communication with the common contact of the power rail.

In a further example of the second aspect and the above examples, the each accessory rail includes a first side power rail shielded by an exterior of the each accessory rail, the each accessory rail including an opening at each access position exposing the first side power rail to define the first side access element. For example, the each accessory rail includes a second side power rail shielded by an exterior of the each accessory rail, the each accessory rail including an opening at each access position exposing the second side power rail to define the second side access element. In an example, the opening has a characteristic diameter in a range of 0.15 mm to 2 mm.

In an additional example of the second aspect and the above examples, the opening has a depth between an outside surface of the exterior of the accessory rail and the power rail in a range of 0.15 mm to 6 mm.

In another example of the second aspect and the above examples, the mounting system further includes a handle including a handle control interface to interface with the plurality of contacts of the control rail, the handle removably attachable at each of the attachment positions of the control rail.

In a further example of the second aspect and the above examples, the set of accessory rails have a Picatinny configuration In an additional example of the second aspect and the above examples, the set of accessory rails have a KeyMod configuration In another example of the second aspect and the above examples, the control rail has a Picatinny configuration.

In a further example of the second aspect and the above examples, the mounting system further includes an accessory device mechanically coupled to an accessory rail of the set of accessory rails at an access point of the plurality of access points and electrically coupled to the first and second access elements. For example, the accessory device includes a light source.

In a third aspect, a mounting system for a firearm is described. The firearm includes a grip, a trigger, a cartridge, and a barrel, a distal end of the barrel defining a front end of the firearm. The mounting system includes a rail assembly extending along the barrel and positioned forward of the grip, trigger, and cartridge, the rail assembly including a plurality of accessory rails and a control rail, the control rail defining a plurality of control positions, each control position having a common contact element and a set of contact supply elements, each accessory rail of the plurality of accessory rails including a first side and a second side and defining a plurality of attachment positions, a common access element defined on the first side of the each accessory rail at each attachment position of the plurality of attachment positions, a supply access element defined on the second side of the each accessory rail at each attachment position of the plurality of attachment positions, the common contact element in electrical communication with the common access element of the each accessory rail and a contact supply of the set of contact supply elements in electrical communication with the supply access element of the each accessory rail; and a handle attached to the control rail at an attachment position of the plurality of attachment positions and forward of the trigger, the handle including a set of connectors to electrically connect with the common contact element and the set of contact supply elements, the handle comprising a power supply, the handle including a mode switch to selectively provide power from the power supply to a select contact supply element and contact supply elements of an associated accessory rail.

In an example of the third aspect, the associated contact is electrically coupled to the first electrical access and the common contact is electrically coupled to the second electrical access via conductive elements disposed in a flange component disposed at an end of the rail assembly.

In another example of the third aspect and the above examples, at each attachment position, the control rail includes a third electrical access at a first side of the control rail and a fourth electrical access at a second side of the power rail, the third electrical access in electrical communication with an associated power rail contact and the fourth electrical access in electrical communication with the common contact of the control rail.

In a further example of the third aspect and the above examples, the each accessory rail includes a first side power rail shielded by an exterior of the each accessory rail, the each accessory rail including an opening at each access position exposing the first side power rail to define the first side access element.

In an additional example of the third aspect and the above examples, the each accessory rail includes a second side power rail shielded by an exterior of the each accessory rail, the each accessory rail including an opening at each access position exposing the second side power rail to define the second side access element. For example, the opening has a characteristic diameter in a range of 0.15 mm to 2 mm. In an example, the opening has a depth between an outside surface of the exterior of the accessory rail and the power rail in a range of 0.15 mm to 6 mm.

In another example of the third aspect and the above examples, the mounting system further includes an accessory device mechanically coupled to an accessory rail of the plurality of accessory rails at an access position of the plurality of access positions and electrical coupled to the first and second access elements. For example, the handle further includes an activation switch, the accessory device activated by selection of the mode switch followed by selection of the activation switch. In an example, the accessory device includes a light source.

In a further example of the third aspect and the above examples, the handle is removably attachable at each of the attachment positions.

In an additional example of the third aspect and the above examples, the plurality of accessory rails have a Picatinny configuration In another example of the third aspect and the above examples, the plurality of accessory rails have a KeyMod configuration In a further example of the third aspect and the above examples, the control rail has a Picatinny configuration.

In an additional example of the third aspect and the above examples, the handle has a grip extending at an angle in a range of 10° to 60°.

In a fourth aspect, a mounting system for a firearm is described. The firearm includes a grip, a trigger, a cartridge, and a barrel, a distal end of the barrel defining a front end of the firearm. The mounting system includes a rail assembly extending along the barrel and positioned forward of the grip, trigger, and cartridge, the rail assembly including a first rail and a second rail, the first rail including first and second contacts, the second rail including third and fourth contacts, the first and second contacts electrically connected to the third and fourth contacts respectively; and a handle attached to first rail of the rail assembly, the handle including a first electrical interface in communication with the first and second contacts and including second electrical interface, the handle comprising a power supply, the handle including a mode switch; and a head assembly mounted to the rail assembly proximal to the front end of the firearm and in electronic communication with the second electrical interface of the handle through a cable, the head assembly including two optical devices operable to project different spectrum; wherein the mode switch of the handle is operable to selectively enable operation of a select optical device of the two optical devices and selectively provide power to the third and fourth contacts.

In an example of the fourth aspect, the handle further includes an activation switch. For example, the mounting system further includes an accessory device mechanically coupled to the second rail and electrically connected to the third and fourth contacts. In an example, the accessory device includes a light source.

In a fifth aspect, a mounting system for a firearm is described. The firearm includes a grip, a trigger, a cartridge, and a barrel, a distal end of the barrel defining a front end of the firearm. The mounting system includes a rail assembly extending along the barrel and positioned forward of the grip, trigger, and cartridge, the rail assembly including accessory rails and a control rail, the control rail defining a plurality of control positions, each control position having a set of contact elements to provide power to accessory rails; and a handle attached to the control rail at a position forward of the trigger and including a power supply, the handle including a first electrical interface to interface with the set of contact elements at a control position of the control rail of the rail assembly, including a second electrical interface to interface with a head assembly having a plurality of light sources, and including a third interface to communicate with a computational device, the handle including a mode switch, the mode switch and the third interface communicatively coupled to a configurable circuitry, the configurable circuitry to selectively provide power to portions of the first or second interfaces based on a configuration provided by the third interface and selection of the mode switch.

In a sixth aspect, a firearm accessory to couple to a firearm is described. The firearm includes a trigger, firing mechanism, and barrel, a distal end of the barrel defining a front of the firearm. The firearm accessory includes a housing defining a central bore and a rail connector, the housing further defining two cavities disposed at the top of the housing on opposite sides and having openings exposed at the front of the housing; two visible light sources each disposed in a cavity of the two cavities, the two visible light sources each including an emitter, a reflector, and a lens; and a plurality of infrared light sources, two infrared light sources of the plurality of infrared light sources disposed on the opposite sides of the housing below the cavities; and an electrical interface disposed to open at a rear of the housing.

In an example of the sixth aspect, the electrical interface is on a right side of the rear of the housing when viewed along the barrel toward the distal end.

In another example of the sixth aspect and the above examples, the housing further comprises a second rail connector.

In a further example of the sixth aspect and the above examples, the second rail connector includes a floating rail.

In an additional example of the sixth aspect and the above examples, the second rail connector is disposed at a bottom of the housing.

In another example of the sixth aspect and the above examples, the rail connector is disposed at a top of the housing.

In a further example of the sixth aspect and the above examples, the housing further includes a power supply compartment to receive a power supply.

In an additional example of the sixth aspect and the above examples, the power supply compartment is disposed at a bottom of the housing.

In another example of the sixth aspect and the above examples, the power supply compartment is accessible via an opening to the rear of the housing.

In a seventh aspect, a firearm includes a grip; a trigger; a cartridge; a barrel, a distal end of the barrel defining a front end of the firearm; and a mounting system of any one of the above aspects and examples.

In an eighth aspect, a firearm includes a grip; a trigger; a cartridge; a barrel, a distal end of the barrel defining a front end of the firearm; a mounting system disposed along the barrel forward of the grip, trigger and cartridge; and a handle attached to the mounting system, the handle including a thumb contact surface, an index finger contact surface, and a palm contact surface separated from the index finger contact surface by a ridge, the thumb contact surface extending outward relative to an axis extending through the barrel, mounting system and handle.

In an example of the eighth aspect, the mounting system has a Picatinny configuration.

In another example of the eighth aspect and the above examples, the handle has a grip extending at an angle in a range of 10° to 60° relative to an axis of the barrel. For example, the angle is in a range of 10° to 45°. In another example, the angle is in a range of 15° to 35°. In a further example, the angle is in a range of 20° to 30°.

In a further example of the eighth aspect and the above examples, the handle includes a head interface and the head includes an electrical interface, the handle interface connected to the head interface.

In an additional example of the eighth aspect and the above examples, the thumb contact surface extend at an angle $\delta$ in a range of 0° to 45°.

In another example of the eighth aspect and the above examples, the handle extends at an angle $\gamma$ in a range of 0° to 45° relative to an axis of symmetry extending downward through the mounting system.

In a ninth aspect, a forward grip is to couple to a firearm. The firearm includes a trigger, a handle, a barrel extending forward from the trigger and the handle, and a handguard or forestock extending along the barrel. The forward grip includes an interface to engage the handguard or forestock forward of the trigger and handle; a body extending downward and rearward from the interface, the body defining an index finger grip surface and defining at least a second grip surface downward and rearward of the index finger grip surface and separated from the index finger grip surface by a ridge; and a thumb paddle extending from a side of the body to engage a thumb below the barrel and below the handguard or fore stock.

In an example of the ninth aspect, the forward grip further includes a buffering structure extending downward from a distal end of the body.

In another example of the ninth aspect and the above examples, the grip has an angle in a range of 10° to 60° relative to an axis of the barrel In a further example of the ninth aspect and the above examples, the index finger grip surface is moveable.

In an additional example of the ninth aspect and the above examples, the forward grip further includes a pressure pad keeper coupled to the body.

In another example of the ninth aspect and the above examples, the pressure pad keeper is disposed on a top surface of the body over the second grip surface.

In a further example of the ninth aspect and the above examples, the pressure pad keeper is disposed on a side surface of the body in proximity to the second grip surface.

In an additional example of the ninth aspect and the above examples, the interface is configured to engage a Picatinny rail.

In another example of the ninth aspect and the above examples, the interface is configured to engage a Keymod mounting structure.

In a further example of the ninth aspect and the above examples, the thumb paddle is moveable to select positions along the side of the body.

In an additional example of the ninth aspect and the above examples, the thumb paddle is rotatable.

In another example of the ninth aspect and the above examples, the thumb paddle includes a polygonal post to engage the body at selectable angles.

In a further example of the ninth aspect and the above examples, the forward grip further includes a second thumb paddle extending from an opposite side of the body relative to the thumb paddle.

In an additional example of the ninth aspect and the above examples, the body defines a cavity opening at the distal end of the body, the forward grip further comprising a back plate to cover the opening.

In a tenth aspect, a firearm includes a trigger; a handle adjacent the trigger; a barrel extending forward from the trigger and the handle; a handguard or forestock extending along the barrel; and a forward grip. The forward grip includes an interface to engage the handguard or forestock forward of the trigger and handle; a body extending downward and rearward from the interface, the body defining an index finger grip surface and defining at least a second grip surface downward and rearward of the index finger grip surface and separated from the index finger grip surface by a ridge; and a thumb paddle extending from a side of the body to engage a thumb below the barrel and below the handguard or fore stock.

In an example of the tenth aspect, the firearm further includes a buffering structure extending downward from a distal end of the body.

In an additional example of the tenth aspect and the above examples, the forward grip has an angle in a range of 10° to 60° relative to an axis of the barrel In a further example of the tenth aspect and the above examples, the index finger grip surface is moveable.

In an additional example of the tenth aspect and the above examples, the firearm further includes a pressure pad keeper coupled to the body.

In another example of the tenth aspect and the above examples, the pressure pad keeper is disposed on a top surface of the body over the second grip surface.

In a further example of the tenth aspect and the above examples, the pressure pad keeper is disposed on a side surface of the body in proximity to the second grip surface.

In an additional example of the tenth aspect and the above examples, the interface is configured to engage a Picatinny rail.

In another example of the tenth aspect and the above examples, the interface is configured to engage a Keymod mounting structure.

In a further example of the tenth aspect and the above examples, the thumb paddle is moveable to select positions along the side of the body.

In an additional example of the tenth aspect and the above examples, the thumb paddle is rotatable.

In another example of the tenth aspect and the above examples, the thumb paddle includes a polygonal post to engage the body at selectable angles.

In a further example of the tenth aspect and the above examples, the firearm further includes a second thumb paddle extending from an opposite side of the body relative to the thumb paddle.

In an additional example of the tenth aspect and the above examples, the body defines a cavity opening at the distal end of the body, the forward grip further comprising a back plate to cover the opening.

As described herein, a forward direction of the firearm is towards the distal end of the barrel at which a bullet exits and rearward is generally associated with a stock or proximity to the rearward handle and trigger. The handle and trigger generally extend in a downward direction and optional sites or alignment devices are disposed in topward of the firearm. While a forward handle or grip is generally described as being disposed on a rail system typically associated with a handguard, in some firearm configuration, such as a shotgun, the forward handle or grip can be disposed on a forestock.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention. While different features and element are described in relation to separate embodiment, it will be understood that such features and elements can be combined in various embodiments.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A forward grip to couple to a firearm, the firearm including a trigger, a handle, a barrel extending forward from the trigger and the handle, and a handguard or forestock extending along the barrel, the forward grip comprising:

an interface to engage the handguard or forestock forward of the trigger and handle;

a body extending downward and rearward from the interface, the body defining an index finger grip surface and defining at least a second grip surface downward and rearward of the index finger grip surface and separated from the index finger grip surface by a ridge; and a thumb paddle extending from a side of the body to engage a thumb below the barrel and below the handguard or forestock, the thumb paddle providing leverage to the body when engaged by the thumb, the thumb paddle immovable relative to the body when secured to the body.

2. The forward grip of claim 1, further comprising a buffering structure extending downward from a distal end of the body.

3. The forward grip of claim 1, wherein the grip has an angle in a range of 10° to 60° relative to an axis of the barrel.

4. The forward grip of claim 1, wherein the index finger grip surface is adjustable.

5. The forward grip of claim 1, further comprising a pressure pad keeper coupled to the body, the pressure pad keeper to receive a pressure pad of a lighting device.

6. The forward grip of claim 5, wherein the pressure pad keeper is disposed on a top surface of the body over the second grip surface.

7. The forward grip of claim 5, wherein the pressure pad keeper is disposed on a side surface of the body in proximity to the second grip surface.

8. The forward grip of claim 1, wherein the thumb paddle is configured to be repositioned to select positions along the side of the body when not secured to the body.

9. The forward grip of claim 8, wherein the thumb paddle is rotatable when positioned at a select position and not secured to the body.

10. The forward grip of claim 1, wherein the thumb paddle includes a polygonal post to engage the body at selectable angles.

11. The forward grip of claim 1, further comprising a second thumb paddle extending from an opposite side of the body relative to the thumb paddle.

12. A firearm comprising:

a trigger;

a handle adjacent the trigger;

a barrel extending forward from the trigger and the handle;

a handguard or forestock extending along the barrel; and a forward grip comprising:

an interface to engage the handguard or forestock forward of the trigger and handle;

a body extending downward and rearward from the interface, the body defining an index finger grip surface and defining at least a second grip surface downward and rearward of the index finger grip surface and separated from the index finger grip surface by a ridge; and a thumb paddle extending from a side of the body to engage a thumb below the barrel and below the handguard or forestock, the thumb paddle providing leverage to the body when engaged by the thumb, the thumb paddle immovable relative to the body when secured to the body.

13. The firearm of claim 12, further comprising a buffering structure extending downward from a distal end of the body.

14. The firearm of claim 12, wherein the forward grip has an angle in a range of 10° to 60° relative to an axis of the barrel.

15. The firearm of claim 12, wherein the index finger grip surface is adjustable.

16. The firearm of claim 12, further comprising a pressure pad keeper coupled to the body, the pressure pad keeper to receive a pressure pad of a lighting device.

17. The firearm of claim 16, wherein the pressure pad keeper is disposed on a top surface of the body over the second grip surface.

18. The firearm of claim 16, wherein the pressure pad keeper is disposed on a side surface of the body in proximity to the second grip surface.

19. The firearm of claim 12, wherein the thumb paddle is configured to be repositioned to select positions along the side of the body when not secured to the body.

20. The firearm of claim 12, wherein the thumb paddle is rotatable when positioned at a select position and not secured to the body.

* * * * *